US010207525B2

(12) United States Patent
Saita

(10) Patent No.: US 10,207,525 B2
(45) Date of Patent: Feb. 19, 2019

(54) IMAGE FORMING APPARATUS AND IMAGE FORMING METHOD

(71) Applicant: FUJIFILM Corporation, Tokyo (JP)

(72) Inventor: Hirofumi Saita, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/712,540

(22) Filed: Sep. 22, 2017

(65) Prior Publication Data

US 2018/0009244 A1 Jan. 11, 2018

Related U.S. Application Data

(63) Continuation of application No. PCT/JP2016/059460, filed on Mar. 24, 2016.

(30) Foreign Application Priority Data

Mar. 25, 2015 (JP) ..... 2015-063137

(51) Int. Cl.
*B41J 13/03* (2006.01)
*B41J 13/076* (2006.01)
(Continued)

(52) U.S. Cl.
CPC ..... *B41J 13/076* (2013.01); *B41J 11/42* (2013.01); *B41J 13/0027* (2013.01); *B41J 13/03* (2013.01);
(Continued)

(58) Field of Classification Search
CPC ..... B41J 13/03
(Continued)

(56) References Cited

U.S. PATENT DOCUMENTS 4,995,184 A * 2/1991 Ebato ..... B41J 13/03 101/296
5,162,857 A * 11/1992 Higeta ..... G03G 15/234 271/251
(Continued)

FOREIGN PATENT DOCUMENTS

JP 2005-67104 A 3/2005
JP 2009-12909 A 1/2009
(Continued)

OTHER PUBLICATIONS

International Preliminary Report on Patentability and Written Opinion of the International Searching Authority (Forms PCT/IB/373, PCT/IB/326 and PCT/ISA/237), dated Oct. 5, 2017, for International Application No. PCT/JP2016/059460, with an English translation of the Written Opinion.
(Continued)

*Primary Examiner* — Anthony Nguyen
(74) *Attorney, Agent, or Firm* — Birch, Stewart, Kolasch & Birch, LLP

(57) ABSTRACT

Provided are an image forming apparatus and an image forming method capable of coping with a medium exceeding a transport limit of a pair of rollers in image formation in which the medium is transported with the medium interposed between the pair of rollers. In a case where a medium exceeding a transport limit of first transport means to which medium transport using a first roller and a second roller is applied is used, second transport means is used to assist in the medium transport performed by the first transport means. The driving of second driving means for driving the second transport means is controlled using a driving signal applied to the driving control of the first driving means for driving the first transport means. Medium transport in which syn-
(Continued)

chronization is taken between the first transport means and the second transport means is realized.

20 Claims, 16 Drawing Sheets

(51) Int. Cl.

| | |
|---|---|
| ***B41J 11/42*** | (2006.01) |
| ***B41J 13/10*** | (2006.01) |
| ***B65H 5/36*** | (2006.01) |
| ***B41J 13/00*** | (2006.01) |
| ***B41J 29/38*** | (2006.01) |
| ***B65H 20/02*** | (2006.01) |
| ***B65H 5/06*** | (2006.01) |
| ***B65H 11/00*** | (2006.01) |
| *B41J 2/04* | (2006.01) |

(52) U.S. Cl.
CPC ..... *B41J 13/10* (2013.01); *B41J 29/38* (2013.01); *B65H 5/062* (2013.01); *B65H 5/36* (2013.01); *B65H 11/002* (2013.01); *B65H 20/02* (2013.01); *B41J 2/04* (2013.01); *B65H 2402/30* (2013.01); *B65H 2403/20* (2013.01); *B65H 2403/55* (2013.01); *B65H 2403/821* (2013.01); *B65H 2404/14* (2013.01)

(58) Field of Classification Search
USPC ..... 400/636
See application file for complete search history.

(56) References Cited

U.S. PATENT DOCUMENTS

| | | | | |
|---|---|---|---|---|
| 5,594,486 | A * | 1/1997 | Kiyohara | B41J 11/005 271/274 |
| 2004/0036893 | A1* | 2/2004 | Sussmeier | B41J 3/54 358/1.5 |
| 2008/0080923 | A1* | 4/2008 | Yasue | B41J 11/0095 400/642 |
| 2009/0092434 | A1* | 4/2009 | Chen | B41J 13/0009 400/636 |
| 2010/0054838 | A1 | 3/2010 | Nakanishi et al. | |
| 2010/0296856 | A1* | 11/2010 | Moriyama | B41J 3/60 400/642 |
| 2011/0211031 | A1* | 9/2011 | Satoh | B65H 23/16 347/104 |
| 2013/0258013 | A1* | 10/2013 | Koshikawa | B41J 11/0015 347/102 |
| 2014/0291926 | A1 | 10/2014 | Iesaki | |

FOREIGN PATENT DOCUMENTS

| | | | |
|---|---|---|---|
| JP | 2010-52282 | A | 3/2010 |
| JP | 2011-51671 | A | 3/2011 |
| JP | 2013-208744 | A | 10/2013 |
| JP | 2014-197319 | A | 10/2014 |

OTHER PUBLICATIONS

International Search Report and English translation (Form PCT/ISA/210), dated May 31, 2016, for International Application No. PCT/JP2016/059460.
Japanese Decision to Grant and English translation, dated Sep. 14, 2017, for Japanese Application No. 2015-063137.

* cited by examiner

IMAGE FORMING APPARATUS AND IMAGE FORMING METHOD

CROSS-REFERENCE TO RELATED APPLICATIONS

The present application is a Continuation of PCT International Application No. PCT/JP2016/059460 filed on Mar. 24, 2016 claiming priority under 35 U.S.C § 119(a) to Japanese Patent Application No. 2015-063137 filed on Mar. 25, 2015. Each of the above applications is hereby expressly incorporated by reference, in their entirety, into the present application.

BACKGROUND OF THE INVENTION

1. Field of the Invention

The present invention relates to an image forming apparatus and an image forming method, and particularly, relates to a medium transport technique in an image forming apparatus capable of doubling as image formation of a roll-like medium and image formation of a plate-shaped medium.

2. Description of the Related Art

As image forming apparatuses that form an image on a roll-like medium in which an elongated medium is wound in the shape of a roll, so-called wide format printer apparatuses are known. In the wide format printer apparatuses, a medium is transported by pinching a medium pulled out from a roll between a grid roller and a pinch roller and by rotating the grid roller. The image forming apparatuses transport a medium with high accuracy to realize high image quality.

In a case where it is necessary to perform image formation on a plate-shaped medium relatively heavier and relatively thicker than a roll medium while using a pair of rollers consisting of the grid roller and the pinch roller for a medium transport unit, the plate-shaped medium is transported using the pair of rollers consisting of the grid roller and the pinch roller, similar to a case where simple tables that become platforms that support a medium are disposed on an upstream side and a downstream side of a printer in a medium transport direction and a roll-like medium is transported.

Image forming apparatuses for which the roll-like medium is mainly used and which can also be applied to the plate-shaped medium are referred to as a hybrid type.

An image forming apparatus that transports a transport plate carrying and supporting a plate-shaped medium, which is thick and is made of wood or the like, using a grid roller, is described in JP2005-067104A. In the image forming apparatus described in JP2005-067104A, transport tables are coupled to the front and back of a machine body, and an image is formed on the plate-shaped medium that is thick and made of wood or the like.

The terms "medium" and "image forming apparatus" in the present specification respectively correspond to a recording medium and a printer in JP2005-067104A.

SUMMARY OF THE INVENTION

However, in the hybrid type image forming apparatuses, image formation onto the plate-shaped medium, such as an aluminum plate, a glass plate, or a wood plate, which has a thickness of about several millimeters to several tens of millimeters and has a weight of about several kilograms to several tens of kilograms, is expected. However, in medium transport using the pair of rollers consisting of the grid roller and the pinch roller, which is applied to the hybrid type image forming apparatuses that have been known from the former, the weight or thickness of applicable media is limited.

If a medium exceeding a weight limit or a medium exceeding a thickness limit in the medium transport using the pair of rollers consisting of the grid roller and the pinch roller is used, slip occurs between the medium and the pair of rollers consisting of the grid roller. As a result, there is a concern that the target transport amount of the medium and the actual transport amount of the medium does not coincide with each other and transport position deviation of the medium occurs. If such transport position deviation of the medium occurs, there is a concern that unevenness occurs in an image.

Therefore, in a case where the medium exceeding the weight limit or the medium exceeding the thickness limit in the medium transport using the pair of rollers consisting of the grid roller and the pinch roller is used, the image formation using the hybrid type image forming apparatuses to which such a transport form is applied is forced to be abandoned.

The image forming apparatus described in JP2005-067104A has a configuration in which the medium is transported using the grid roller, and has a weight limit of the medium or a thickness limit of the medium. In a case where the medium exceeding the weight limit or the medium exceeding the thickness limit is used, it is difficult to obtain desired image quality due to the occurrence of the above-described transport position deviation of the medium.

The invention has been made in view of such circumstances, and an object thereof is to provide an image forming apparatus and an image forming method capable of coping with a medium exceeding a transport limit of a pair of rollers in image formation in which the medium is transported with the medium pinched between the pair of rollers.

In order to achieve the above object, the following aspects are provided.

An image forming apparatus according to a first aspect is an image forming apparatus comprising first transport means for pinching a medium between a first roller and a second roller and driving at least any one of the first roller or the second roller to transport the medium; image forming means for forming an image on the transported medium; first driving means for driving at least any one of the first roller or the second roller, the first driving means including first coupling means coupled to at least any one of the first roller or the second roller, and a first driving source coupled to at least any one of the first roller or the second roller via the first coupling means; first driving control means for controlling the driving of the first driving means; driving signal output means for outputting a driving signal to be applied to the control of the driving of the first driving means; second transport means disposed on at least any one of an upstream side or a downstream side of the image forming means in a medium transport direction for assisting in the transport of the medium by the first transport means; second driving means for driving the second transport means; second driving control means for controlling the driving of the second driving means; and driving signal transmission means for transmitting a driving signal, which is output from the driving signal output means, to the second driving control means. The second driving control means controls the driving of the second driving means using the driving signal transmitted by the driving signal transmission means.

According to the first aspect, in a case where the medium exceeding the transport limit of the first transport means is used, it is possible to assist in the medium transport performed by the first transport means using the second transport means. Since the driving of the second driving means for driving the second transport means is controlled using the driving signal applied to the driving control of the first driving means for driving the first transport means, medium transport in which synchronization is taken between the first transport means and the second transport means can be realized In a second aspect based on the image forming apparatus of the first aspect, it is possible to adopt a configuration in which the image forming apparatus further comprises a medium fixing plate to which the medium is fixed, the second transport means is provided on the upstream side and the downstream side of the image forming means in the medium transport direction, and the medium fixing plate has a length over the second transport means provided on the upstream side and the downstream side of the image forming means in the medium transport direction.

In the second aspect, an aspect in which a position detecting means is attached to the medium fixing plate and the position of the medium fixing plate is detected by the position detecting means is preferable. An aspect in which a detection result is applied to the driving control of the second driving means is preferable.

In a third aspect based on the image forming apparatus of the first aspect or the second aspect, it is possible to adopt a configuration in which the image forming apparatus further comprises medium supporting means having a first support surface that supports the medium in an image formation region of the image forming means, parallelism detecting means for detecting the parallelism of a second support surface that is a surface of the second transport means which supports the medium, the parallelism detecting means including light beam radiation means for radiating a light beam serving a reference within a plane parallel to the first support surface, and parallelism adjustment means for adjusting the parallelism of the second support surface on the basis of a detection result of the parallelism detecting means.

According to the third aspect, the parallelism between the first support surface and the second support surface where the medium is supported in the image formation region formed by the image forming means, can be kept in a certain range, a transport abnormality, such as the torsion of the medium during transport, is prevented.

In a fourth aspect based on the image forming apparatus of the third aspect, it is possible to adopt a configuration in which the parallelism detecting means detects the warping of the medium supported by the second support surface.

According to the fourth aspect, the warping of the medium can be ascertained. In the fourth aspect, by adjusting the distance between the first support surface and the image forming means according to the degree of the warping of the medium, the collision between the medium and the image forming means is prevented.

In a fifth aspect based on the image forming apparatus of the third aspect or the fourth aspect, it is possible to adopt a configuration in which the image forming means includes a head that forms an image on the medium, and scanning means for making the head perform scanning in a direction orthogonal to the medium transport direction, and the light beam radiation means is disposed in the scanning means.

According to the fifth aspect, the parallelism and the warping of the medium can be detected in the total range of the scanning range of the head by disposing the light beam radiation means in the scanning means.

In a sixth aspect based on the image forming apparatus of any one aspect of the first aspect to the fifth aspect, it is possible to adopt a configuration in which the driving signal output means is an encoder attached to the first driving source, and the driving signal transmission means transmits a pulse signal, which is output from the encoder, to the second driving control means.

According to the sixth aspect, the driving control of the second driving means synchronized with the driving of the first driving means is possible.

In a seventh aspect based on the image forming apparatus of the sixth aspect, it is possible to adopt a configuration in which the driving signal transmission means includes a first driving signal transmission wiring line that transmits the driving signal output from the encoder, a driving signal output terminal provided in the first driving control means and connected to the first driving signal transmission wiring line, a second driving signal transmission wiring line connected to the driving signal output terminal, and a driving signal input terminal provided in the second driving control means and connected to the second driving signal transmission wiring line.

According to the seventh aspect, the driving signal is transmitted from the first driving means via the first driving control means to the second driving control means.

In an eighth aspect based on the image forming apparatus of the sixth aspect, it is possible to adopt a configuration in which the driving signal transmission means includes a first driving signal transmission wiring line that transmits the driving signal output from the encoder, and a driving signal input terminal provided in the second driving control means and connected to the first driving signal transmission wiring line.

According to the eighth aspect, the driving signal is directly transmitted from the first driving means to the second driving control means.

In a ninth aspect based on the image forming apparatus of any one aspect of the first aspect to the eighth aspect, it is possible to adopt a configuration in which the second driving means includes second coupling means coupled to the second transport means, and a second driving source that is coupled to the second transport means via the second coupling means and whose driving is controlled by the second driving control means on the basis of the driving signal.

In the ninth aspect, it is possible to adopt a configuration in which a speed reducer is included in the second coupling means.

In a tenth aspect based on the image forming apparatus of the ninth aspect, it is possible to adopt a configuration in which the second coupling means includes a stepless variable speed reducer configured to be capable of adjusting a reduction ratio in a stepless manner, and the second driving control means adjusts the reduction ratio of the stepless variable speed reducer.

According to the tenth aspect, the reduction ratio of the second driving means can be made variable in a stepless manner.

In an eleventh aspect based on the image forming apparatus of the ninth aspect, it is possible to adopt a configuration in which the second driving control means controls the driving of the second driving source in correspondence with a reduction ratio to be set for the second driving source on the basis of the driving signal.

According to the eleventh aspect, the reduction ratio of the second driving means can be made variable in a stepless manner by the driving control.

In a twelfth aspect based on the image forming apparatus of any one aspect of the first aspect to the eleventh aspect, it is possible to adopt a configuration in which the first transport means, the first driving means, the first driving control means, the image forming means, and the driving signal output means are housed in a main body unit, the second transport means, the second driving means and the second driving control means are constituted as an optional device, and the driving signal is transmitted to the second driving control means using the driving signal transmission means when using the optional device.

According to the twelfth aspect, in a case where a medium equal to or lower than the transport limit of the first transport means is applied, it is possible to perform image formation using the medium equal to or lower than the transport limit of the first transport means without attaching the optional device or with the optional device being removed.

In a thirteenth aspect based on the image forming apparatus of any one aspect of the first aspect to the twelfth aspect, it is possible to adopt a configuration in which the image forming apparatus further comprises medium transport control parameter setting means for setting a medium transport control parameter applied to the second driving control means.

According to the thirteenth aspect, in the medium transport using the first transport means and the second transport means, the slip between the first transport means and the second transport means, and the medium is prevented, and the transport position deviation of the medium is prevented.

In a fourteenth aspect based on the image forming apparatus of the thirteenth aspect, it is possible to adopt a configuration in which the medium transport control parameter setting means sets a transport acceleration correction coefficient of the second transport means with respect to a medium transport acceleration of the first transport means, a value exceeding 0 and less than 1 being set in the transport acceleration correction coefficient.

According to the fourteenth aspect, the slip between the first transport means and the medium is prevented, and the transport position deviation of the medium when sending the medium from the second transport means to the first transport means is prevented.

In a fifteenth aspect based on the image forming apparatus of the thirteenth aspect or the fourteenth aspect, it is possible to adopt a configuration in which the medium transport control parameter setting means sets a transport start preceding period showing a period in which a medium transport start timing of the second transport means is made to precede a medium transport start timing of the first transport means.

According to the fifteenth aspect, the transport position deviation of the medium when sending the medium from the second transport means to the first transport means is prevented by making the driving start of the second transport means precede the driving start of the first transport means.

In a sixteenth aspect based on the image forming apparatus of the thirteenth aspect or the fourteenth aspect, it is possible to adopt a configuration in which the medium transport control parameter setting means sets a correction start transport speed that is a transport speed of the second transport means at which the correction of the medium transport speed of the second transport means is started.

According to the sixteenth aspect, the transport position deviation of the medium when sending the medium from the second transport means to the first transport means is prevented by setting the correction start transport speed.

In a seventeenth aspect based on the image forming apparatus of the sixteenth aspect, it is possible to adopt a configuration in which the medium transport control parameter setting means sets a value, which is obtained by multiplying a maximum value of the medium transport speed by the first transport means by a coefficient exceeding 0 and less than 1, as the correction start transport speed.

According to the seventeenth aspect, the medium transport speed of the second transport means can be made slower than the medium transport speed of the first transport means.

In an eighteenth aspect based on the image forming apparatus of any one aspect of the thirteenth aspect to the seventeenth aspect, it is possible to adopt a configuration in which the medium transport control parameter setting means sets a value, which is obtained by multiplying a maximum value of the medium transport speed by the first transport means by a coefficient exceeding 0 and less than 1, as a transport speed coefficient.

According to the eighteenth aspect, the transport position deviation of the medium when sending the medium from the second transport means to the first transport means is prevented by making the medium transport speed of the second transport means slower than the medium transport speed of the first transport means.

In a nineteenth aspect based on the image forming apparatus of any one aspect of the first aspect to the eighteenth aspect, it is possible to adopt a configuration in which the image forming apparatus further comprises a reference potential connection wiring line that electrically connects a reference potential of the first driving control means and a reference potential of the second driving control means to each other.

According to the nineteenth aspect, an abnormality resulting from static electricity generated by the friction between the medium and the second transport means when transporting the medium using the second transport means is prevented.

An image forming method according to a twentieth aspect is an image forming method for forming an image, using imaging forming means, on a medium transported by first transport means for pinching the medium between a first roller and a second roller and driving at least any one of the first roller or the second roller to transport the medium. The image forming method comprises a first driving step of driving first driving means including first coupling means coupled to at least any one of the first roller or the second roller and a first driving source coupled to at least any one of the first roller or the second roller via the first coupling means; a second driving step of assisting in the transport of the medium by the first transport means using second transport means disposed on at least any one of an upstream side or a downstream side of the image forming means in a medium transport direction and of driving second driving means for driving the second transport means; and a driving signal output step of outputting a driving signal applied to the driving control of the first driving means. The second driving step controls the driving of the second driving means using the driving signal output in the driving signal output step.

In the twentieth aspect, the same items as the items specified from the second aspect to the nineteenth aspect can be appropriately combined together. In that case, means as means for performing processing or functions specified in the image forming apparatus can be ascertained as an element of steps of processing or operations corresponding to this.

According to the invention, in a case where the medium exceeding the transport limit of the first transport means is used, it is possible to assist in the medium transport performed by the first transport means using the second transport means. Since the driving of the second driving means for driving the second transport means is controlled using the driving signal applied to the driving control of the first driving means for driving the first transport means, the medium transport in which the synchronization is taken between the first transport means and the second transport means can be realized.

DESCRIPTION OF THE PREFERRED EMBODIMENTS

Preferred embodiments of the invention will be described below in detail according to the accompanying drawings.

First Embodiment

Overall Configuration

Figure 1:
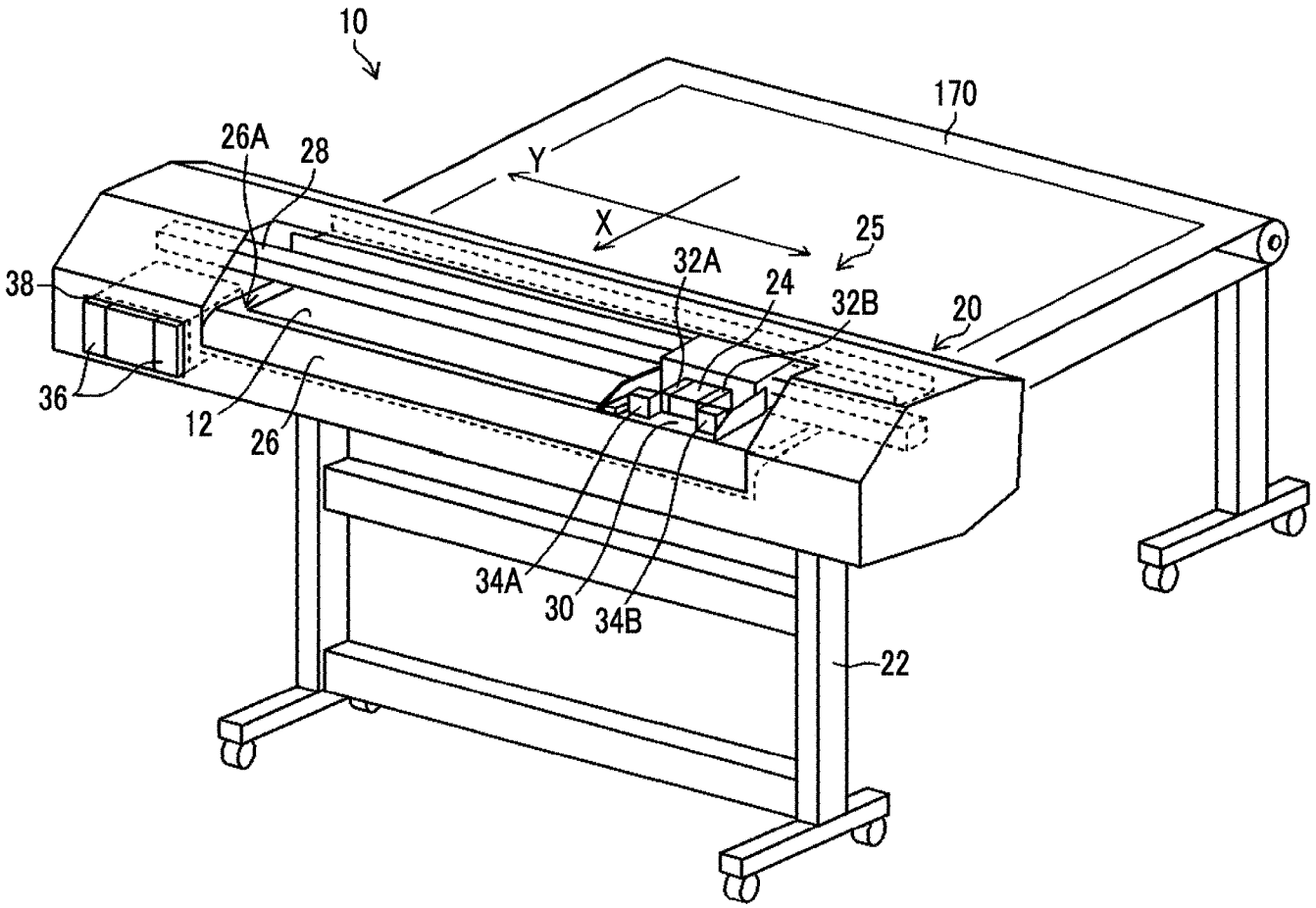
FIG. 1 is an overall configuration view of an ink jet recording apparatus related to a first embodiment of the invention.

FIG. 1 is an overall configuration view of an ink jet recording apparatus related to a first embodiment of the invention. An ink jet recording apparatus 10 illustrated in FIG. 1 is one aspect of an image forming apparatus. The ink jet recording apparatus 10 is a wide format printer that forms a color image on a medium 12 using ink having the performance of being cured by radiating active light beams, such as ultraviolet rays.

Although the image formation using the ink cured by radiating ultraviolet rays is exemplified in the present embodiment, the ink applied to the invention is not limited to the ink cured by radiating ultraviolet rays. For example, ink cured by heating and/or natural drying may be used.

The wide format printer is an apparatus that is suitable to perform image formation on wide regions, such as a large-sized poster and a wall surface commercial advertisement. In the present specification, one corresponding to enlarged A3 or more is referred to as the wide format. Here, A3 is the size of base paper of paper based on ISO 216:2007 (ISO is short for International Organization for Standardization), and enlarged A3 paper means paper larger than A3, that is, a given margin (blank space) being provided on A3 paper.

The ink jet recording apparatus 10 includes a main body unit 20, and a support leg 22 that supports the main body unit 20. A drop-on-demand type ink jet head 24 that discharges ink toward the medium 12, a platen 26 including a first support surface 26A that supports the medium 12, a guide mechanism 28 that supports the ink jet head so as to be movable in a scanning direction Y, and a carriage 30 that is loaded with the ink jet head 24 and moves along the guide mechanism 28 are provided as an image forming unit 25 in the main body unit 20.

The ink jet head 24, the guide mechanism 28, and the carriage 30 are constituent elements that constitute the image forming unit 25 that is one aspect of image forming means. Additionally, the ink jet head is one aspect of a head that forms an image on a medium. A configuration consisting of the guide mechanism 28 and the carriage 30 is one aspect of scanning means.

The ink jet recording apparatus 10 includes a first transport unit, which is not illustrated in FIG. 1, in the main body unit 20. The first transport unit that is not illustrated in FIG. 1 is illustrated with reference sign 150 in FIG. 2. The ink jet recording apparatus 10 includes a second transport unit 170 that assists in medium transport of the first transport unit that is not illustrated in FIG. 1. The first transport unit 150 is equivalent to first transport means. The second transport unit 170 is equivalent to second transport means.

Although an aspect in which the second transport unit 170 is provided on an upstream side of the image forming unit 25 in a medium transport direction is exemplified in FIG. 1, an aspect in which the second transport unit 170 is provided on a downstream side of the image forming unit 25 is also possible.

In an aspect in which the second transport units 170 are provided on both the upstream side and the downstream side of the image forming unit 25 in the medium transport direction, the medium 12 is fixed on a medium fixing plate that is not illustrated in FIG. 1, and the medium 12 is transported by moving the medium fixing plate. The medium fixing plate is illustrated with reference sign 11 in FIG. 2. The details of the first transport unit, the second transport unit, and the medium fixing plate will be described below.

The scanning direction is illustrated with reference sign Y in FIG. 1. Additionally, a transport direction of the medium 12 orthogonal to the scanning direction Y is illustrated with reference sign X. In the present specification, the scanning direction is handled as being synonymous with a main scanning direction. Additionally, the transport direction of the medium 12 is handled as being synonymous with a sub-scanning direction. In the following description, there is case where the transport direction of the medium 12 is described as the medium transport direction.

The guide mechanism 28 is disposed so as to extend in the scanning direction Y orthogonal to the medium transport direction X above the platen 26. Additionally, the guide mechanism 28 is disposed within a plane parallel to the first support surface 26A of the platen 26.

The term "orthogonal" or "perpendicular" in the present specification includes "substantially orthogonal" or "substantially perpendicular" that exhibits the same working effects as those in a case where intersection is made at 90 degrees, in a case where intersection is made at an angle exceeding 90 degrees or a case where intersection is made at an angle less than 90 degrees.

Additionally, the term "parallel" in the present specification includes "substantial parallel" that exhibits the same working effects as those in "parallel", though two directions intersect each other.

Moreover, the same term in the present specification includes "substantially the same" that can obtain the same working effects, through a difference is present in terms of a target configuration.

The carriage 30 is supported so as to be reciprocable movement in the scanning direction Y along the guide mechanism 28. The carriage 30 is loaded with the ink jet head 24. Additionally, the carriage 30 is loaded with temporary curing light sources 32A and 32B and main curing light sources 34A and 34B that irradiate ultraviolet rays to the ink adhering to the medium 12.

The temporary curing light sources 32A and 32B may be referred to as pinning light sources. The exposure performed by the temporary curing light sources 32A and 32B may be referred to as temporary curing treatment or pinning. The main curing light sources 34A and 34B may be referred to as curing light sources. The exposure performed by the main curing light sources 34A and 34B may be referred to as main curing treatment or curing.

The temporary curing light sources 32A and 32B are light sources that irradiate ultraviolet rays that temporarily cures ink to such a degree that adjacent ink droplets do not coalesce with each other after the ink discharged from the ink jet head 24 has landed the medium 12. The ultraviolet rays radiated from the temporary curing light sources 32A and 32B temporarily cure ink to such a degree that landing interference is avoided. Additionally, the ultraviolet rays irradiated from the temporary curing light sources 32A and 32B temporarily cures ink to such a degree that the ink is sufficiently deployed as a spread dot.

The main curing light sources 34A and 34B are light sources that perform additional exposure on ink on which the temporary curing treatment is performed and that finally radiate ultraviolet rays that cure the ink completely.

The ink jet head 24, the temporary curing light source 32A, the temporary curing light source 32B, the main curing light source 34A, and the main curing light source 34B, which are disposed in the carriage 30, move integrally with the carriage 30 along the guide mechanism 28.

In FIG. 1, an attachment part 38 of an ink cartridge 36 is provided on a left front surface toward a front surface of the main body unit 20. The ink cartridge 36 is a replaceable ink tank that stores ink.

Additionally, although illustration is omitted, a maintenance unit of the ink jet head 24 is provided on a right side toward the front surface of the main body unit 20. The maintenance unit that is not illustrated is provided with a cap for moisturizing the ink jet head 24 in a non-image formation period, and a wiping-out member for cleaning a nozzle surface of the ink jet head 24. The cap for capping the nozzle surface of the ink jet head 24 is provided with an ink receptacle for receiving the ink discharged from a nozzle for maintenance. In addition, the nozzle surface is illustrated with reference sign 70B in FIG. 8.

The nozzle surface of the ink jet head 24 may be referred to as a discharge surface, an ink discharge surface, or the like. Examples of the wiping-out member include a blade and a web.

Description of Medium Transport

Figure 2:
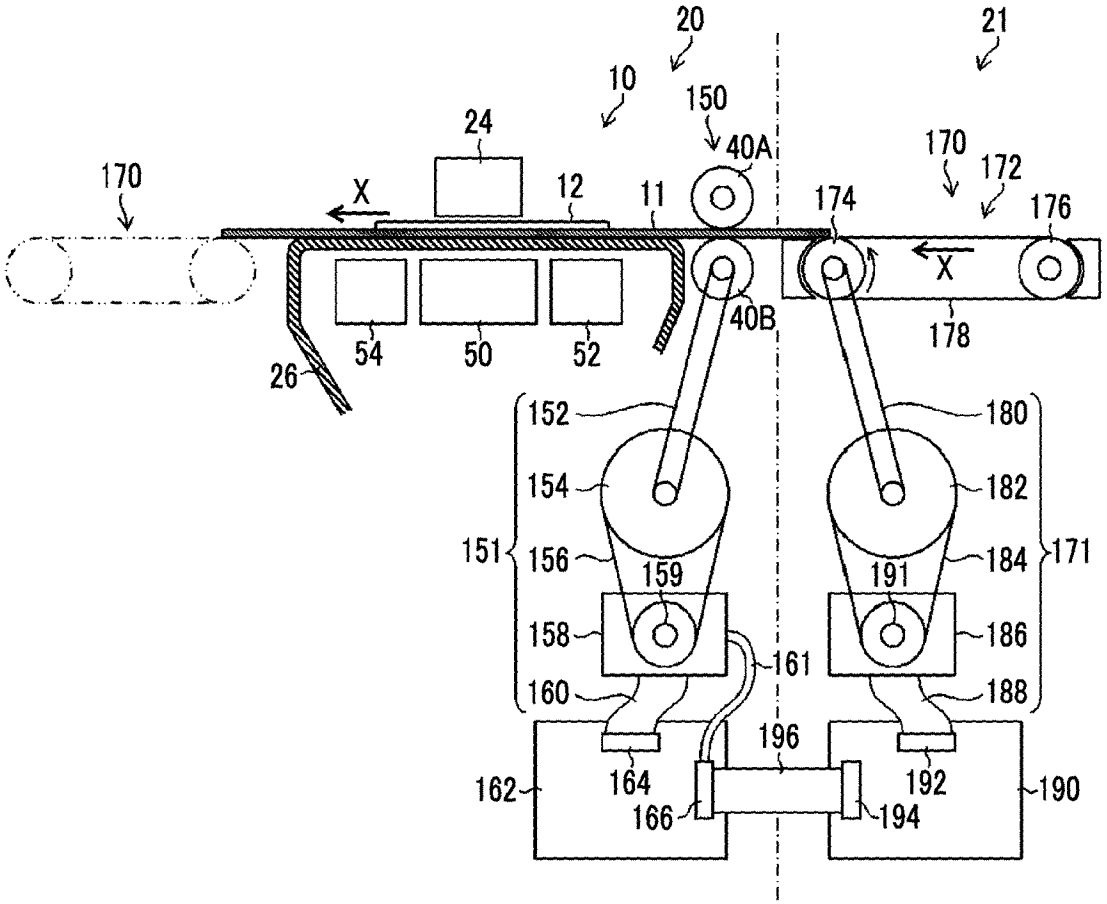
FIG. 2 is an explanatory view schematically illustrating a medium transport configuration in the ink jet recording apparatus illustrated in FIG. 1.

FIG. 2 is an explanatory view schematically illustrating a medium transport configuration in the ink jet recording apparatus illustrated in FIG. 1. As illustrated in FIG. 2, the ink jet recording apparatus 10 includes the first transport unit 150 and the second transport unit 170 as means for transporting the medium 12.

The first transport unit 150 pinches the medium 12 between a pair of rollers consisting of a pinch roller 40A and a grid roller 40B, and drives the grid roller 40B, thereby transporting the medium 12 inserted between the pinch roller 40A and the grid roller 40B in the medium transport direction X. The grid roller 40B and the pinch roller 40A are one aspect of a first roller or a second roller.

Although an aspect in which the grid roller 40B is driven is exemplified in the present embodiment, the pinch roller 40A may be driven or both the grid roller 40B and the pinch roller 40A may be driven.

The grid roller 40B had a structure in which a grid having a convex shape is provided on a surface made to abut against the medium 12 or the medium fixing plate 11, and prevents any slip between the medium 12 and the grid roller 40B by the action of the grid. In addition, illustration of the grid is omitted.

The first transport unit 150 includes a pinch roller moving mechanism that moves the pinch roller 40A up and down to make the distance between the pinch roller 40A and the grid roller 40B variable. The distance between the pinch roller 40A and the grid roller 40B is adjusted according to the thickness of a medium 12 by the pinch roller moving mechanism. Illustration of the pinch roller moving mechanism is omitted.

A first driving unit 151 that drives the first transport unit 150 includes a first belt 152, a first gear 154, a second belt 156, a first motor 158, a first driving power transmission wiring line 160, and a first motor driver 162. The grid roller 40B of the first transport unit 150 is coupled to the first gear 154 via the first belt 152. The first gear 154 is coupled to a rotary shaft 159 of the first motor 158 via the second belt 156.

The first driving unit 151 is equivalent to first driving means. The first belt 152, the first gear 154, and the second belt 156 are one aspect of first coupling means. The first motor 158 is one aspect of a first driving source. The first motor driver 162 is one aspect of first driving control means.

The reduction ratio of the first gear 154 is determined according to a driving force required for the first transport unit 150, the generated torque of the first motor 158, and the transport speed of the medium 12. Additionally, the rotational speed and the rotation resolving power of the first motor 158 are determined according to the transport speed of the medium 12 and the reduction ratio of the first gear 154.

The first motor 158 is electrically connected to a driving power output terminal 164 of the first motor driver 162 via the first driving power transmission wiring line 160. The driving power supplied to the first motor 158 is output to the driving power output terminal 164.

An encoder that is not illustrated in FIG. 2 is attached to the first motor 158. A driving signal output from the encoder is transmitted to a driving signal output terminal 166 of the first motor driver 162 via a first driving signal transmission wiring line 161.

Illustration of an attachment structure of the first motor 158 and the encoder is omitted. The encoder that is not illustrated in FIG. 2 is equivalent to a first encoder 115 of FIG. 4. This encoder is one aspect of driving signal output means.

The first motor driver 162 has the driving signal output terminal 166 that is electrically connected to the first driving signal transmission wiring line 161. The driving signal output terminal 166 is an input terminal for a driving signal delivered from the first motor 158, and is an output terminal for a driving signal delivered to a second motor driver 190.

The second transport unit 170 is a transport table that transports the medium 12. The second transport unit 170 includes a conveyor 172 as means for supporting the medium 12 or supporting and transporting the medium fixing plate 11. The conveyor 172 has a structure in which an endless third belt 178 is wound around a driving roller 174 and a driven roller 176. By rotating the driving roller 174 in a counterclockwise direction in FIG. 2, the medium 12 supported by the third belt 178 is transported in the medium transport direction X. The second transport unit 170 is equivalent to the second transport means.

In a case where the medium 12 exceeding a transport limit of the first transport unit 150 is used, transport of the medium 12 is performed using the first transport unit 150 and the second transport unit 170. The second transport unit 170 has the function of assisting in the medium transport performed by the first transport unit 150.

The second transport unit 170, a second driving unit 171, and the second motor driver 190 have a structure capable of being mechanically separated from the main body unit 20 in which the first transport unit 150 and the like are housed, and can be constituted as an optional device 21 capable of being electrically separated from the main body unit. One-point dashed line illustrated in FIG. 2 is a boundary between the main body unit 20 and the optional device 21.

Examples of the medium 12 exceeding the transport limit of the first transport unit 150 include plate-shaped medium, such as an aluminum plate, a glass plate, or a wood plate having a thickness of about several millimeters to several tens of millimeters and having a weight of several kilograms to several tens of kilograms.

That is, the medium 12 exceeding the transport limit of the first transport unit 150 includes the medium 12 having a weight exceeding a weight limit or the medium 12 having a thickness exceeding a thickness limit.

The medium having a weight exceeding the weight limit of the first transport unit 150 is a medium in which slip occurs between the medium and the grid roller 40B and the transport distance of the medium may not correspond to the rotational amount of the grid roller 40B.

The medium having a thickness exceeding the thickness limit of the first transport unit 150 is a medium in which slip occurs between the medium and the grid roller 40B and the transport distance of the medium may not correspond to the rotational amount of the grid roller 40B when the medium cannot be pinched between the grid roller 40B and the pinch roller 40A and the medium is transported by the grid roller 40B.

The second driving unit 171 that drives the conveyor 172 illustrated in FIG. 2 includes a fourth belt 180, a second gear 182, a fifth belt 184, a second motor 186, and a second driving power transmission wiring line 188.

The driving roller 174 of the conveyor 172 is coupled to the second gear 182 via the fourth belt 180. The second gear 182 is coupled to a rotary shaft 191 of the second motor 186 via the fifth belt 184. The second driving unit 171 is equivalent to second driving means. The second motor 186 is one aspect of a second driving source. The fourth belt 180, the second gear 182, and the fifth belt 184 are one aspect of second coupling means.

The reduction ratio of the second gear 182 is determined according to a driving force required for the second transport unit 170, the generated torque of the second motor 186, and the transport speed of the medium 12. Additionally, the rotational speed and the rotation resolving power of the second motor 186 are determined according to the transport speed of the medium 12 by the second transport unit 170 and the reduction ratio of the second gear 182.

The second motor 186 is electrically connected to a second driving power output terminal 192 of the second motor driver 190 via the second driving power transmission wiring line 188. The second motor driver 190 supplies driving power to the second motor 186 via the second driving power transmission wiring line 188.

The second motor driver 190 has a driving signal input terminal 194 to which a driving signal output from the driving signal output terminal 166 of the first motor driver 162 is input. The driving signal input terminal 194 of the second motor driver 190 is electrically connected to the driving signal output terminal 166 of the first motor driver 162 via a second driving signal transmission wiring line 196.

A driving signal is delivered to the second motor driver 190 via the first motor driver 162. The second motor driver 190 controls the driving of the second motor 186 on the basis of the driving signal delivered from the first motor driver 162. In the present embodiment, an aspect in which the driving of the second motor 186 is controlled in synchronization with the driving of the first motor 158.

Specific examples of the driving signal include a biphasic pulse signal that is output from the encoder attached to the rotary shaft 159 of the first motor 158 and is synchronized with the rotation of the rotary shaft 159 of the first motor 158.

Additionally, other examples of the driving signal include a signal showing the operation of the grid roller 40B. That is, the driving signal is a signal that is applied to the control when driving the grid roller 40B, and is a signal showing the operation of the grid roller 40B or the operation of the first motor 158 that is the driving source of the grid roller 40B.

In the biphasic pulse signal output from the encoder, the phase of an A-phase signal and the phase of a B-phase signal are shifted by 90 degrees from each other. By analyzing the biphasic pulse signal output from the encoder, parameters, such as the rotational speed and the rotational amount of the first motor 158, such as the driving start timing of the first motor 158, the rotational direction of the first motor 158, the driving stop timing of the first motor 158, the rotational speed of the first motor 158, and the rotational amount of the first motor 158, can be ascertained.

The second motor driver 190 controls the driving of the second motor 186 on the basis of the parameters of the first motor 158 acquired from the analysis results of the driving signal.

In a case where a servo motor is applied to the first motor 158, the first motor 158 and an optical encoder are integrated with each other, and a driving signal is delivered from the first motor 158 to the first motor driver 162. The first motor driver 162 performs feedback control on the first motor 158 on the basis of the driving signal.

The second motor driver 190 acquires a driving signal via the driving signal output terminal 166 of the first motor driver 162, and the driving signal input terminal 194. The driving of the second motor 186 is controlled using information on the acquired driving signal and the reduction ratio of the first gear 154.

That is, the second motor driver 190 controls the driving of the second motor 186 in synchronization with the driving of the first motor 158 by using pulse width modulation applied to the feedback driving control of the first motor 158 for the driving control of the second motor 186.

The first driving signal transmission wiring line 161, the driving signal output terminal 166 of the first motor driver 162, the driving signal input terminal 194 of the second motor driver 190, and the second driving signal transmission wiring line 196, which are illustrated in FIG. 2, constitute one aspect of driving signal transmission means.

If the grid roller 40B of the first transport unit 150 rotates, the second motor driver 190 receives a driving signal applied to the driving control of the first motor 158 that rotates the grid roller 40B, drives the second motor 186, and drives the conveyor 172 that constitutes the second transport unit 170. The second motor driver 190 is one aspect of second driving control means.

That is, the medium 12 supported by the conveyor 172 is transported on the basis of the driving signal applied to the driving control of the first motor 158 that is a driving source of the first transport unit 150. By virtue of a configuration in which the first transport unit 150 and the second transport unit 170 are driven in synchronization with each other, a medium exceeding the transport limit of the first transport unit 150 can be transported.

In the ink jet recording apparatus 10 illustrated in FIG. 2, the platen 26 is disposed on a downstream side of the first transport unit 150 in the medium transport direction X. The platen 26 supports the medium 12 transported by the first transport unit 150 on the first support surface 26A. The platen 26 is one aspect of medium supporting means.

Image formation is executed by the ink jet head 24 if the medium 12 that is intermittently transported in the medium transport direction X reaches an image formation region immediately below the ink jet head 24. The medium 12 on which an image is formed is transported in the medium transport direction X.

In the image formation region of the ink jet head 24, a temperature adjustment unit 50 that adjusts the temperature of the medium 12 during image formation is provided on the side opposite to the first support surface 26A of the platen 26 at a position that faces the ink jet head 24. If the temperature of the medium 12 during image formation is adjusted so as to fall within a predetermined temperature range, physical property values, such as the viscosity or the surface tension of the ink that has landed the medium 12, become desired values. As a result, it is possible to obtain the desired diameter of dots. If necessary, a pre-temperature adjustment unit 52 may be provided on an upstream side of the temperature adjustment unit 50, or an after temperature adjustment unit 54 may be provided on a downstream side of the temperature adjustment unit 50. In FIG. 2, reference sign of the first support surface 26A is omitted.

Although an aspect in which the second transport unit 170 is disposed on the upstream side of the first transport unit 150 in the medium transport direction X as means for assisting in the transport of the medium 12 by the first transport unit 150 is exemplified in the present embodiment, the second transport unit 170 may be disposed on the downstream side of the first transport unit 150 in the medium transport direction X.

In FIG. 2, the second transport unit 170 that is provided on the downstream side of the first transport unit 150 in medium transport direction X and on the downstream side of the ink jet head 24 in the medium transport direction X is illustrated using one-point dashed line.

Additionally, an aspect in which the second transport units 170 are provided on both the upstream side and the downstream side of the first transport unit 150 in the medium transport direction X is also preferable. That is, the second transport unit 170 is disposed on at least any one of the upstream side in the medium transport direction X by the first transport unit 150 or the downstream side in medium transport direction X by the first transport unit 150. The second driving unit 171 and the second motor driver 190 are provided in an accompanying manner in the second transport unit 170.

In the aspect in which the second transports unit 170 are provided on the upstream side and the downstream side of the first transport unit 150 in the medium transport direction X, the transport of the medium 12 is performed using the medium fixing plate 11. The medium fixing plate 11 has a length ranging from the second transport unit 170 disposed on the upstream side of the first transport unit 150 to the second transport unit 170 disposed on the downstream side of the first transport unit 150 illustrated using the one-point dashed line in FIG. 2, in the medium transport direction X. The details of the transport of the medium 12 using the medium fixing plate 11 will be described below.

The medium fixing plate 11 has a length in the medium transport direction X such that the medium fixing plate the driving roller 174 of the second transport unit 170 disposed on the upstream side of the first transport unit 150 and a roller, on the first transport unit 150 side, of the second transport unit 170 disposed on the downstream side of the first transport unit 150.

In an aspect in which the second transport unit 170 is disposed on either the upstream side or the downstream side of the first transport unit 150 in the medium transport direction, the medium fixing plate 11 may be omitted.

That is, in an aspect in which the medium 12 is pinched between the pinch roller 40A and the grid roller 40B, an aspect in which the medium 12 is directly pinched between the pinch roller 40A and the grid roller 40B, and an aspect in which the medium 12 is indirectly pinched by pinching the medium fixing plate 11 for fixing the medium 12 between the pinch roller 40A and the grid roller 40B can be adopted.

Additionally, as an aspect in which the medium 12 is supported by the first support surface 26A of the platen 26 or an aspect in which the medium 12 is supported by a second support surface 172A of the second transport unit 170, an aspect in which the medium 12 is directly supported, or an aspect in which the medium 12 is indirectly supported by supporting the medium fixing plate 11 for fixing the medium 12 can be adopted.

Description of Other Medium Transport

Figure 3:
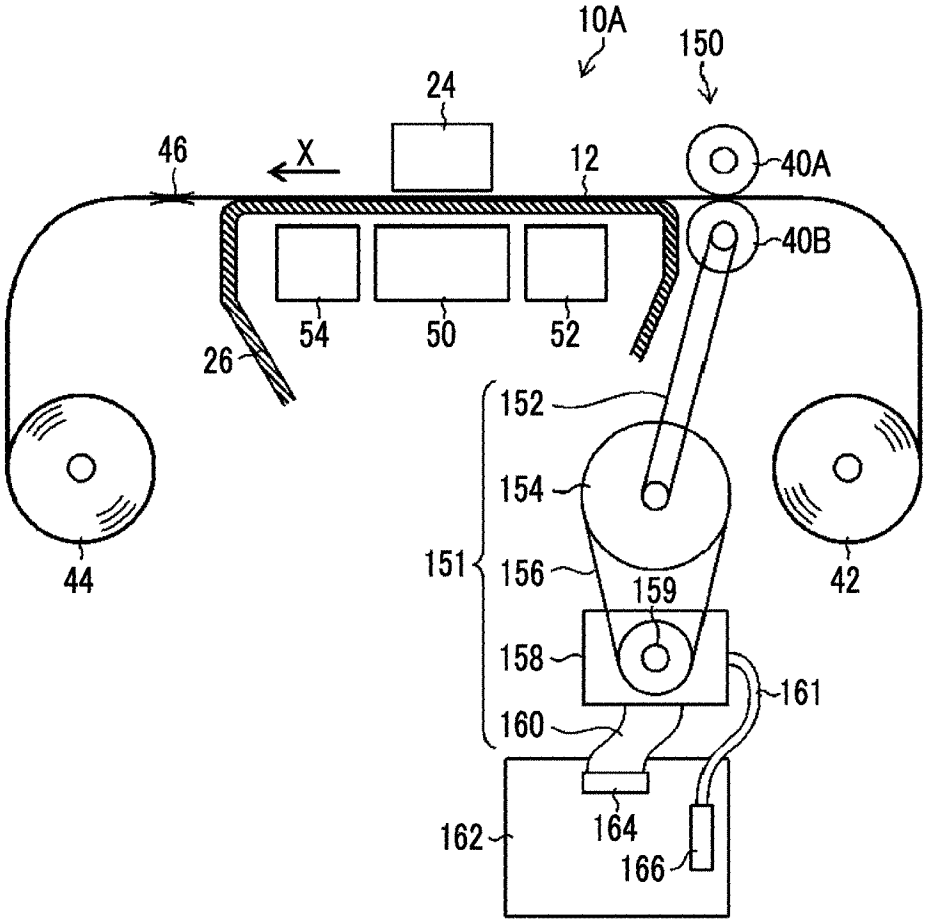
FIG. 3 is an explanatory view schematically illustrating another medium transport configuration in the ink jet recording apparatus illustrated in FIG. 1.

FIG. 3 is an explanatory view schematically illustrating another medium transport configuration in the ink jet recording apparatus illustrated in FIG. 1. In FIG. 3, the same components as those of FIG. 2 will be designated by the same reference signs, and the description thereof will be appropriately omitted. Additionally, illustration of some components of the first transport unit 150 is omitted in FIG. 3.

An ink jet recording apparatus 10A illustrated in FIG. 3 is one in which the optional device 21 is removed from the ink jet recording apparatus 10 illustrated in FIG. 2, and is applied to image formation using a roll-like medium.

The roll-like medium illustrated in FIG. 3 is an elongated medium, and represents a state where a lightweight and thin medium is wound in a roll form. Here, the term "lightweight medium" is a medium having a weight equal to or lower than the weight limit of the first transport unit 150. Additionally, the term "thin medium" is a medium having a thickness equal to or lower than the thickness limit of the first transport unit 150, and a medium in which slip does not occur between the medium and the grid roller 40B when the medium is pinched and transported between the pinch roller 40A and the grid roller 40B.

In a case where the medium equal to or lower than the transport limit of the first transport unit 150 is used like the above medium, it is possible to transport the medium 12 by removing the optional device 21 illustrated in FIG. 2, or by not using the second transport unit 170 illustrated in FIG. 2.

A state where the optional device 21 illustrated in FIG. 2 is removed, a supply-side roll 42 is housed in a supply-side roll housing part that is not illustrated in FIG. 3, and a winding-side roll 44 is housed in a winding-side roll housing part that is not illustrated in FIG. 3 is illustrated in FIG. 3.

The medium 12 pulled out from the supply-side roll 42 as illustrated in FIG. 3 is intermittently transported in the medium transport direction X by the first transport unit 150. On the medium 12 that has reached the image formation region immediately below the ink jet head 24, image formation is performed by the ink jet head 24. The medium 12 on which the image formation is performed passes through a guide 46, and is wound around the winding-side roll 44.

Although the roll-like medium is exemplified as the medium equal to or lower than the transport limit of the first transport unit 150, a sheetlike medium can be applied to FIG. 3 as the medium equal to or lower than the transport limit of the first transport unit 150.

Configuration of Control System

Figure 4:
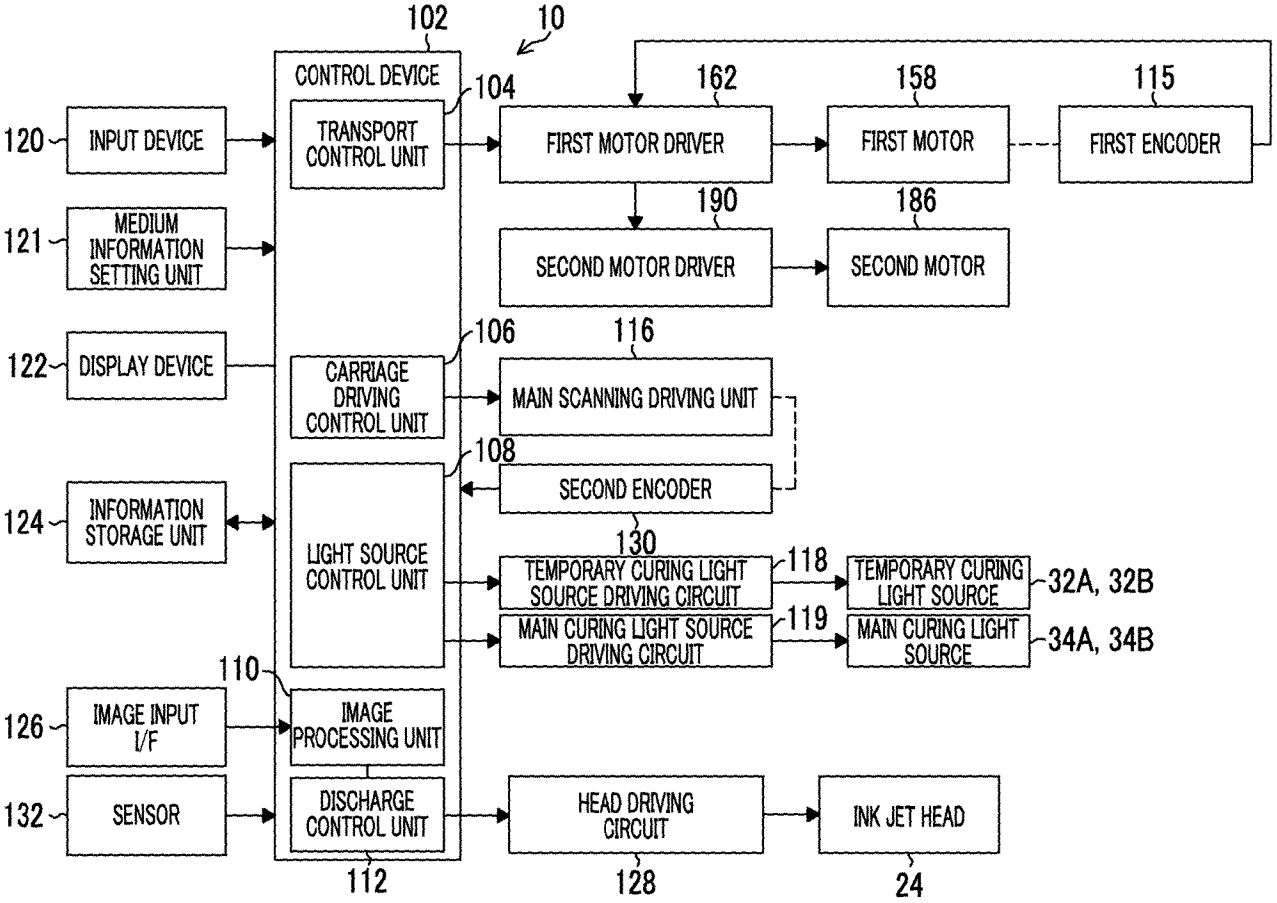
FIG. 4 is a block diagram of a control system of the ink jet recording apparatus illustrated in FIG. 1.

FIG. 4 is a block diagram illustrating the configuration of main parts of the control system of the ink jet recording apparatus 10. In FIG. 4, the same components as those of FIGS. 1 to 3 will be designated by the same reference signs, and the description thereof will be appropriately omitted.

As illustrated in FIG. 4, the ink jet recording apparatus 10 includes a control device 102 that functions as means for integrally controlling respective parts of the apparatus.

As the control device 102, a computer including a central processing unit and the like can be applied. Additionally, the control device 102 functions as an arithmetic device that performs various arithmetic operations. A transport control unit 104, a carriage driving control unit 106, a light source control unit 108, an image processing unit 110, and a discharge control unit 112 are included in the control device 102.

The respective parts that constitute the control device 102 are realized by hardware circuits, software, or combinations thereof.

The transport control unit 104 delivers a command signal to the first motor driver 162 on the basis of image formation parameters, such as input image data and an image formation mode. The first motor driver 162 controls the driving of the first motor 158 on the basis of the command signal delivered from the transport control unit 104.

The second motor driver 190 controls the operation of the second motor 186 on the basis of a driving signal that is output from the first encoder 115 attached to the first motor 158 and that controls the driving of the first motor 158 delivered via the first motor driver 162.

The carriage driving control unit 106 illustrated in FIG. 4 controls the driving of a main scanning driving unit 116 that makes the carriage 30 illustrated in FIG. 1 perform scanning in the scanning direction Y. A driving motor coupled to a moving mechanism of the carriage 30, and a control circuit thereof are included in the main scanning driving unit 116.

The light source control unit 108 controls ON/OFF, the quantity of irradiation light, and the like in the temporary curing light sources 32A and 32B via a temporary curing light source driving circuit 118. The light source control unit 108 controls ON/OFF, the quantity of irradiation light, and the like in the main curing light sources 34A and 34B via a main curing light source driving circuit 119.

The wavelength bands of ultraviolet rays applied to the temporary curing light sources 32A and 32B are determined according to the properties of ink to be used. Additionally, the quantities of irradiation light of ultraviolet rays applied to the temporary curing light sources 32A and 32B are adjusted according to the properties of ink to be used and the contents of an image to be formed.

The wavelength bands of ultraviolet rays applied to the main curing light sources 34A and 34B are determined according to the properties of ink to be used.

An input device 120, a medium information setting unit 121, and a display device 122 are connected to the control device 102. The input device 120 is means for manually inputting an external operation signal to the control device 102, for example, various forms, such as a keyboard, a mouse, a touch panel, and operation buttons, can be used.

The medium information setting unit 121 sets information on the medium 12 to be used. Information from which at least the weight of the medium 12 can be ascertained is included in the information on the medium 12. The information on the medium 12 set by the medium information setting unit 121 is stored in an information storage unit 124. The information on the medium 12 stored in the information storage unit 124 is applied to the medium transport control performed by the transport control unit 104.

As an aspect in which the information on the medium 12 is acquired, an aspect in which input is directly made using input means, such as the input device 120, and an aspect in which information on the type of the medium 12 is acquired and reading is made from the information on the medium 12 for each type of the medium 12 which is stored in advance can be applied. As the type of the medium 12, an aspect in which the type of the medium 12 is directly input using the input means, such as the input device 120, or an aspect in which the type of the medium 12 is detected using detecting means, such as a sensor 132, can be applied.

A liquid crystal display device or the like can be adopted as the display device 122. An operator can operate the input device 120, thereby performing the setting of an image formation mode, the setting of image formation conditions, the input of attached information, or the editing of the attached information, and can confirm various kinds of information, such as the contents of input and search results through the display of the display device 122.

The ink jet recording apparatus 10 is provided with the information storage unit 124 that stores various kinds of information, and an image input interface 126 for importing image data for image formation. A serial interface may be applied to the image input interface, or a parallel interface may be applied to the image input interface. This portion may be loaded with a buffer memory (not illustrated) for accelerating communication.

The image data input via the image input interface 126 is converted into dot data by the image processing unit 110. Generally, the dot data is created by performing color conversion processing and halftone processing on multi-grayscale image data. The color conversion processing is, for example, processing in which image data of which the grayscales are expressed in 8 bits for respective RGB colors is converted into color data of respective ink colors to be used with the ink jet recording apparatus 10. In addition, in terms of RGB, R represents red, G represents green, and B represents blue.

The half-tone processing is processing in which color data of respective colors generated by the color conversion processing converted into dot data of the respective colors through the processing of an error diffusion method, a threshold value matrix, or the like. As means for half-tone processing, various well-known means, such as the error diffusion method, a dither method, the threshold value matrix method, or a density pattern method, can be applied. The half-tone processing converts grayscale image data of an M value, which is generally three or more integers, into grayscale image data of an N value, which is an integer less than the M value. In the simplest example, conversion into binary dot image data showing ON/OFF of dots is made. However, in the half-tone processing, it is also possible to perform multi-value quantization corresponding to the type of dot size.

The dot data obtained through the processing of the color conversion processing, the half-tone processing, or the like is used as discharge control data for controlling the driving or non-driving of each nozzle. Additionally, the dot data is used as the discharge control data for controlling the dot size in the case of the multiple values.

The discharge control unit 112 generates a discharge control signal for a head drive circuit 128 on the basis of the dot data generated by the image processing unit 110. The head drive circuit 128 generates a driving voltage of the ink jet head 24 on the basis of the discharge control signal sent from the discharge control unit 112, and supplies the driving voltage to the ink jet head 24.

A program executed by the central processing unit of the control device 102, and various kinds of data required for control are stored in the information storage unit 124. Feed amount information required for the control of medium transport, such as the setting information of resolution according to an image formation mode and the number of paths, control information on the temporary curing light sources 32A and 32B and the main curing light sources 34A and 34B, and the like are stored in the information storage unit 124.

The first encoder 115 outputs a biphasic pulse signal as a driving signal. The driving signal output from the first encoder 115 is delivered to the second motor driver 190 via the first motor driver 162.

As the first encoder, a rotary encoder capable of being attached to a rotor of the first motor 158 can be applied. Additionally, in a case where the first motor 158 is a linear motor, a linear actuator in which a linear motion mechanism is configured integrally with a rotary motor, or the like, a linear encoder can be applied.

The second encoder 130 is attached to the driving motor (not illustrate) of the main scanning driving unit 116, and outputs a pulse signal according to the rotational amount of the driving motor, and the rotational speed of the driving motor. The pulse signal output from the second encoder 130 is sent to the control device 102. The position of the carriage 30 and the position of the medium 12, which are illustrated in FIG. 1, are ascertained on the basis of the pulse signal output from the second encoder 130.

As the sensor 132 illustrated in FIG. 4, sensors provided in the respective parts of the apparatus are included. For example, the sensor includes a parallelism detecting sensor that detects the parallelism between a surface of the conveyor 172 illustrated in FIG. 2 which supports the medium 12, and the first support surface 26A of the platen 26. The details of parallelism detection will be described below.

Although illustration is omitted, the ink jet recording apparatus 10 includes a pump control unit that controls a pump disposed in an ink flow passage or the like, and a valve control unit that controls a valve disposed in the ink flow passage or the like.

The pump control unit controls the operation of the pump on the basis of a command delivered from the control device 102. The pump is illustrated with reference sign 90 and reference sign 97 in FIG. 9.

The valve control unit controls the operation of the valve on the basis of a command delivered from the control device 102. The valve is illustrated with reference sign 96 in FIG. 9.

In addition, the configuration of the control system is not limited to the configuration illustrated in FIG. 4. As the configuration of the control system, the configuration illustrated in FIG. 4 can be appropriately changed, added, or deleted.

Modification Example of Driving Signal Transmission of First Motor

Figure 5:
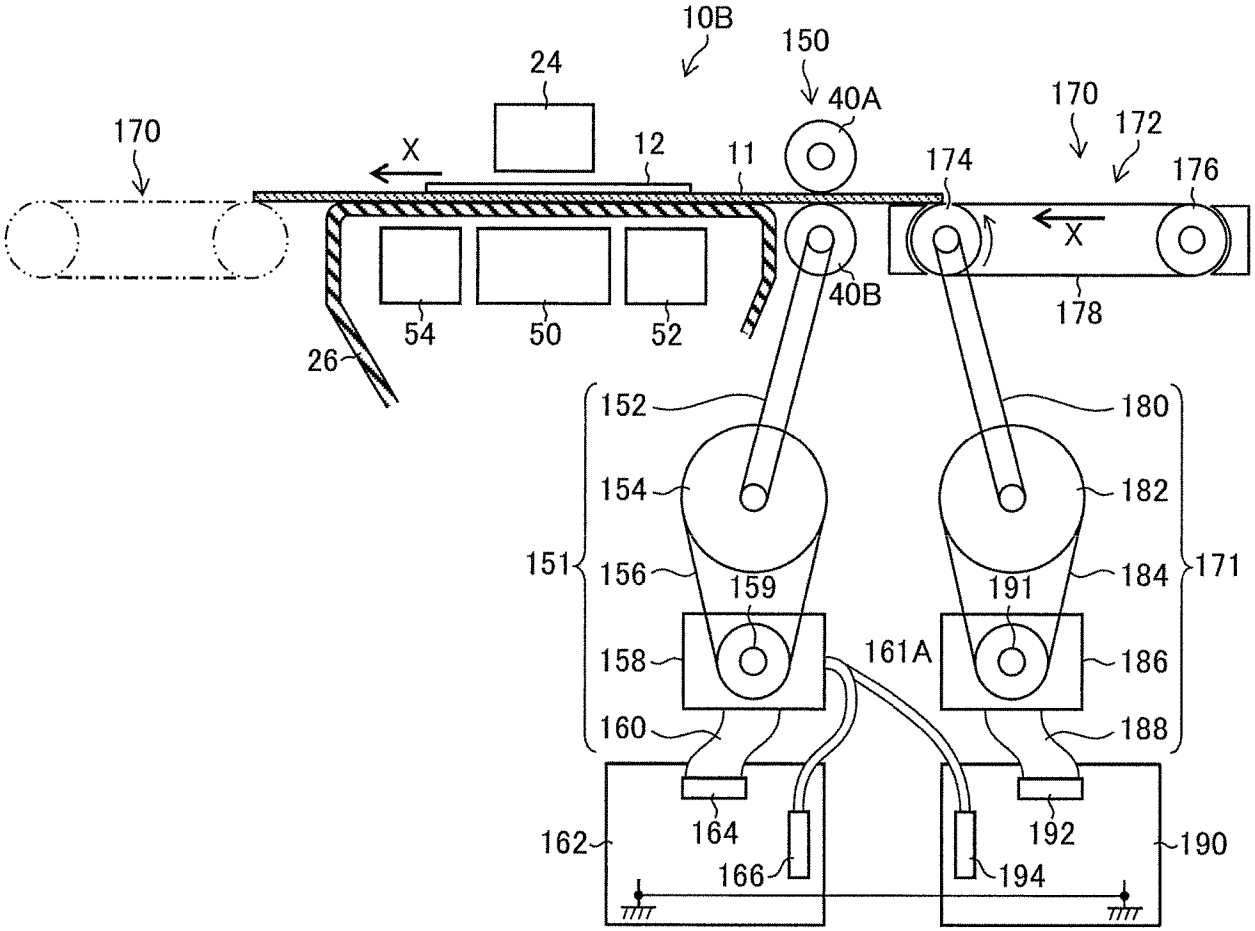
FIG. 5 is an explanatory view of a modification example of driving signal transmission of a first motor.

FIG. 5 is an explanatory view of a modification example of driving signal transmission of the first motor. In FIG. 5, the same components as those of FIGS. 1 to 4 will be designated by the same reference signs, and the description thereof will be appropriately omitted.

In an ink jet recording apparatus 10B illustrated in FIG. 5, a driving signal output from the encoder attached to the first motor 158 is delivered from the first motor 158 via a first driving signal transmission wiring line 161A to the second motor driver 190.

That is, The first driving signal transmission wiring line 161A, which is electrically connected to the encoder attached to the rotary shaft 159 of the first motor 158, is eclectically connected to the driving signal input terminal 194 of the second motor driver 190 without going through the first motor driver 162.

According to the ink jet recording apparatus 10B related to the modification example configured as above, the same working effects as those of the ink jet recording apparatus 10 and the image forming method related to the first embodiment can be obtained.

Additionally, since the driving signal is directly transmitted from the first motor 158 to the second motor driver 190 without going through the first motor driver 162, an improvement in the noise-proof performance of the driving signal wiring line expected.

In the present embodiment, the biphasic pulse signal output from the encoder attached to the first motor 158 is exemplified as the driving signal. However, the driving signal is a signal that can realize synchronous driving between the first motor 158 and the second motor 186, and may be a signal capable of being acquired from the first motor 158 or the first motor driver 162.

Modification Example of Second Transport Unit

As a modification example of the second transport unit 170 illustrated in FIG. 2, an aspect in which the medium fixing plate 11 is provided on a second support surface 172A of the conveyor 172 and the medium 12 is transported with the medium 12 being fixed to the medium fixing plate 11 is possible.

In the present modification example, the second transport unit 170 is disposed on the upstream side of the first transport unit 150 illustrated in FIG. 2 in the medium transport direction, and the second transport unit 170 is disposed also on the downstream side of the first transport unit 150 in the medium transport direction.

The medium fixing plate 11 has a length over both the second transport unit 170 on the upstream side and second transport unit 170 on the downstream side, in the medium transport direction X. As the medium fixing plate 11, a metallic plate can be applied. Means for fixing the medium 12 capable of being applied to the medium fixing plate 11 includes, fixation by suction, fixation by static electricity, and the like.

By attaching a wire encoder to the medium fixing plate 11 and analyzing an output signal from the wire encoder, it is possible to accurately ascertain the amount of transport of the medium fixing plate 11, and by delivering the output signal from the wire encoder to the first motor driver 162, the first motor driver 162 is able to perform the feedback control of the first motor 158 on the basis of the output signal of the wire encoder.

Similarly, by delivering the output signal from the wire encoder to the second motor driver 190, the second motor driver 190 is able to perform the feedback control of the second motor 186 on the basis of the output signal of the wire encoder.

That is, the wire encoder is one aspect of the driving signal output means. As the wire encoder, the linear sensor LMO-AV002-0412-2C00-ARW made by FRABA can be applied.

Other modification examples of the second transport unit 170 include a transporting mechanism using a ball screw illustrated in FIG. 2, a transporting mechanism using a linear motor, and the like.

Configuration of Image Forming Unit

Figure 6:
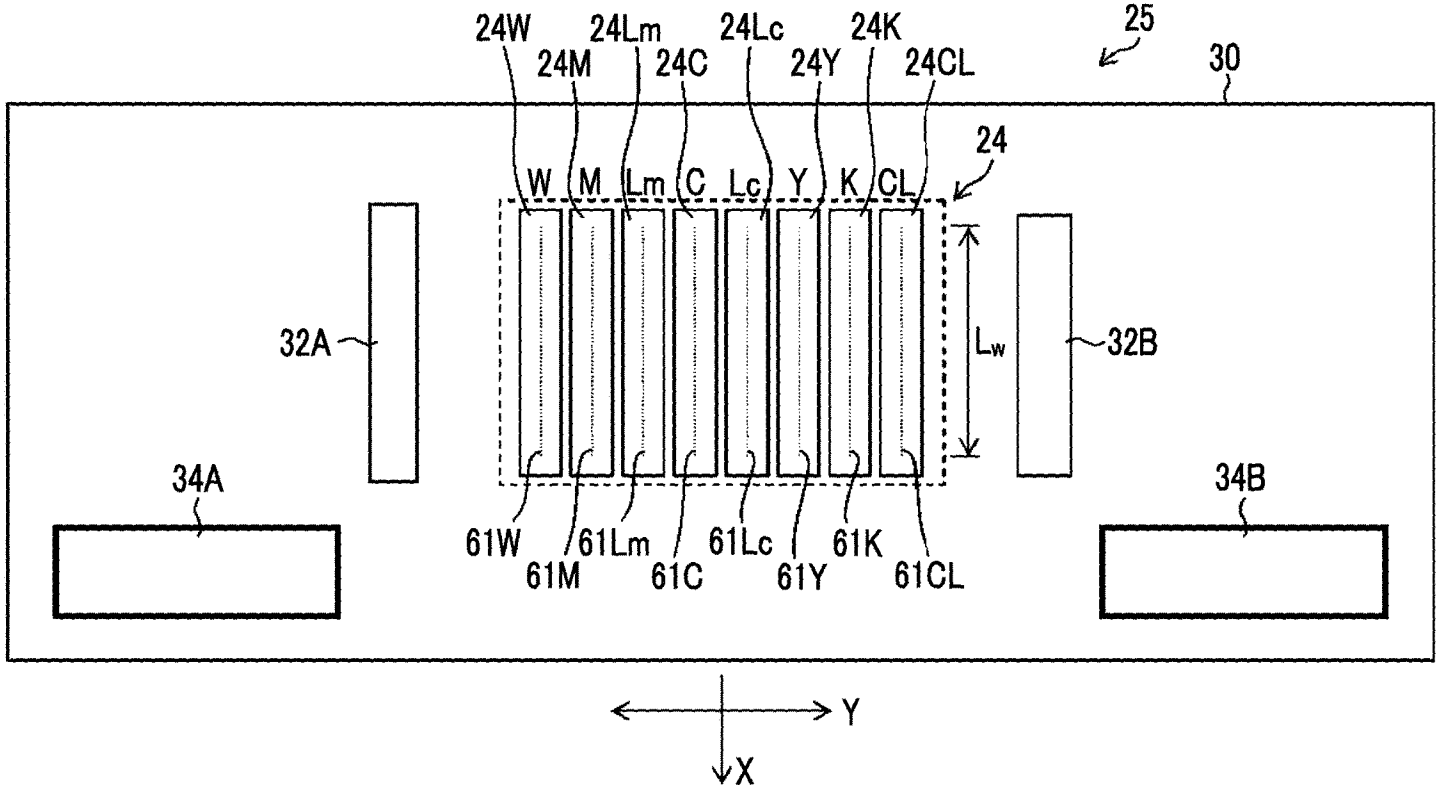
FIG. 6 is a plan perspective view illustrating a schematic configuration of an image forming unit.

FIG. 6 is a plan perspective view illustrating a schematic configuration of the image forming unit. The image forming unit 25 illustrated in FIG. 6 can be applied to any of the ink jet recording apparatus 10 illustrated in FIG. 2, the ink jet recording apparatus 10A illustrated in FIG. 3, the ink jet recording apparatus 10B illustrated in FIG. 5, and an ink jet recording apparatus to which an image forming method related to a second embodiment to be described below is applied.

The image forming unit 25 illustrated in FIG. 6 includes the ink jet head 24, the temporary curing light source 32A, the temporary curing light source 32B, the main curing light source 34A, and the main curing light source 34B. The image forming unit 25 is loaded on the carriage 30, and performs scanning in the scanning direction Y.

The ink jet head 24 includes a white ink head 24W including a nozzle row 61W for discharging white ink. The ink jet head 24 includes a magenta ink head 24M including a nozzle row 61M for discharging magenta ink.

The ink jet head 24 includes a light magenta ink head 24Lm including a nozzle row 61Lm for discharging light magenta ink. The ink jet head 24 includes a cyan ink head 24C including a nozzle row 61C for discharging cyan ink.

The ink jet head 24 includes a light cyan ink head 24Lc including a nozzle row 61Lc for discharging light cyan ink. The ink jet head 24 includes a yellow ink head 24Y including a nozzle row 61Y for discharging yellow ink.

The ink jet head 24 includes a black ink head 24K including a nozzle row 61K for discharging black ink. The ink jet head 24 includes a clear ink head 24CL including a nozzle row 61CL for discharging clear ink.

In the present specification, white may be represented using W, magenta may be represented using M, light magenta may be represented using Lm, cyan may be represented using C, light cyan may be represented using Lc, yellow may be represented using Y, black may be represented using K, and clear may be expressed using CL.

In FIG. 6, the nozzle row are illustrated by dotted lines, and individual illustration of nozzles is omitted. In a case where the nozzle rows of the respective colors do not need to be distinguished from each other, the nozzle rows may be represented using reference signs 61, and alphabets representing the colors may be omitted.

The types of the ink colors and the combinations of the colors are not limited to the present embodiment. For example, a form in which the nozzle row 61Lc of light cyan and the nozzle row 61Lm of light magenta are omitted, a form in which the nozzle row 61CL of clear ink and the nozzle row 61W of white ink are omitted, a form in which a nozzle row of metal ink is omitted, a form in which a nozzle row of metal ink is provided instead of the nozzle row 61W of white ink, a form in which a nozzle row for discharging special color ink is added, and the like are possible.

Additionally, the arrangement order of the nozzle rows 61 for the respective colors are also not particularly limited.

However, a configuration in which ink, which has a low curing sensitivity with respect to ultraviolet rays, among a plurality of types of ink, is disposed closer to the temporary curing light source 32A or the temporary curing light source 32B is preferable.

Each nozzle row 61 is one in which a plurality of nozzles are lined up in a line in the medium transport direction X at regular intervals. Examples of the nozzle arrangement of the ink jet head 24 include an example in which the nozzle arrangement interval in the medium transport direction X is 254 micrometers, and the number of nozzles that constitute one nozzle row 61 is 256 nozzles.

If 254 micrometers equivalent to 1 inch are expressed in the units of the number of dots per inch, 100 dots per inch is established. Additionally, the whole length Lw of one nozzle row in the medium transport direction X is about 64.8 mm.

The ink jet head 24 illustrated in FIG. 6 can perform discharge at a discharge frequency of 15 kHz. Additionally, three-step discharge volumes can be used according to a driving voltage. Examples of the three-step discharge volumes include 10 picoliters, 20 picoliters, and 30 picoliters. The discharge volumes can be changed by changing driving voltage waveforms.

A multi-path system is applied to image formation using the ink jet head 24 illustrated in FIG. 6. Additionally, exposure control of the temporary curing light sources 32A and 32B and the main curing light sources 34A and 34B is performed in correspondence to the image formation of the multi-path system.

Structure of Ink Jet Head

Figure 7A:
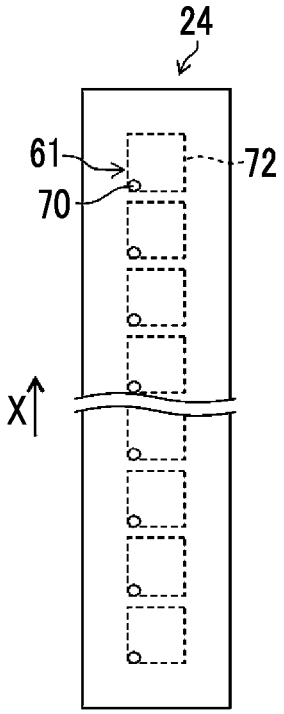
FIG. 7A is a plan view of a nozzle surface illustrating a nozzle arrangement of an ink jet head.
Figure 7B:
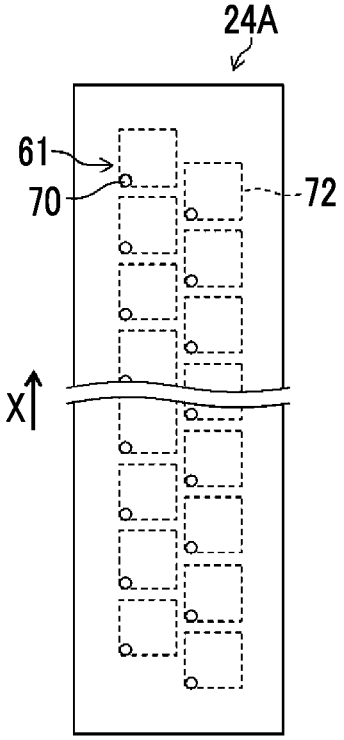
FIG. 7B is a plan view of a nozzle surface illustrating another nozzle arrangement of the ink jet head.

FIG. 7A is a plan view of a nozzle surface illustrating a nozzle arrangement of the ink jet head. FIG. 7B is a plan view of a nozzle surface illustrating another nozzle arrangement of the ink jet head.

The nozzle arrangement illustrated in FIG. 7A and the nozzle arrangement illustrated in FIG. 7B can be applied to any of the ink jet recording apparatus 10 illustrated in FIG. 2, the ink jet recording apparatus 10A illustrated in FIG. 3, the ink jet recording apparatus 10B illustrated in FIG. 5, and the ink jet recording apparatus to which the image forming method related to the second embodiment to be described below is applied.

FIG. 7A illustrates a form in which a nozzle row 61 equivalent to one color constitutes one ink jet head 24. As illustrated in FIG. 7A, in the nozzle row 61 equivalent to one color, a plurality of nozzles 70 are disposed in one row in a direction parallel to the medium transport direction X. Each nozzle 70 communicates with a pressure chamber 72 where the ink to be discharged is contained. In FIGS. 7A and 7B, the pressure chamber 72 is illustrated by a dashed line.

An ink jet head 24A illustrated in FIG. 7B has a structure in which the plurality of nozzles 70 are alternately disposed (disposed in zigzag) in two rows.

Figure 8:
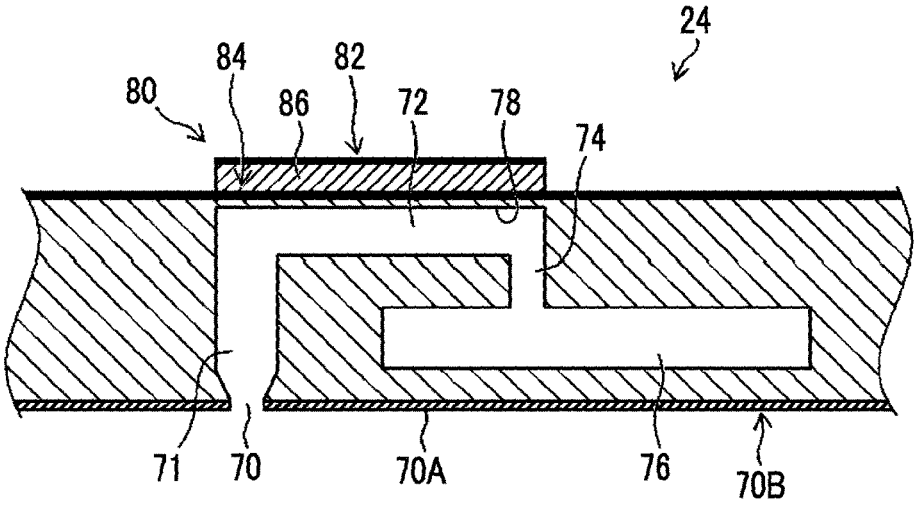
FIG. 8 is a sectional view illustrating a 3-dimensional structure of the ink jet head.

FIG. 8 is a sectional view illustrating a 3-dimensional structure of the ink jet head. The 3-dimensional structure of the ink jet head illustrated in FIG. 8 can be applied to any of the ink jet recording apparatus 10 illustrated in FIG. 2, the ink jet recording apparatus 10A illustrated in FIG. 3, the ink jet recording apparatus 10B illustrated in FIG. 5, and the ink jet recording apparatus to which the image forming method related to the second embodiment to be described below is applied.

In FIG. 8, a structure equivalent to one nozzle is illustrated. The structure equivalent to one nozzle may be replaced with a structure equivalent to one discharge element. A piezo-jet system that jets ink according to deformation of a piezoelectric element 80 is applied to the ink jet head 24.

As a discharge system of the ink jet head 24, it is also possible to apply a thermal system that includes a heater for heating ink within the pressure chamber 72 and discharging ink from the nozzle 70 using a film-boiling phenomenon of the ink.

The pressure chamber 72 communicates with the nozzle 70 via a nozzle flow passage 71. The pressure chamber 72 communicates with a common flow passage 76 via a supply port 74. The common flow passage 76 communicates with the pressure chamber 72 illustrated in FIG. 8 corresponding to each of the nozzles 70 that constitute the nozzle row 61 illustrated in FIG. 7A, and supplies ink to each pressure chamber 72.

The piezoelectric element 80 is provided at a position corresponding to the pressure chamber 72 of an outer surface of the pressure chamber 72 in a vibration plate 78 that constitutes a ceiling surface of the pressure chamber 72. The piezoelectric element 80 has a structure in which a piezoelectric body 86 is inserted between an upper electrode 82 and a lower electrode 84, and if a driving voltage is supplied to between the upper electrode 82 and the lower electrode 84, strain deformation occurs and the vibration plate 78 is deformed.

If a driving voltage is supplied to the piezoelectric element 80 according to image data, the vibration plate 78 is deformed to reduce the volume of the pressure chamber 72, and ink with a volume corresponding to a reduction in the volume of the pressure chamber 72 is discharged from the nozzle 70. If the supply of the driving voltage to the piezoelectric element 80 is stopped, the pressure chamber 72 is restored to its original shape by the strain deformation of the piezoelectric element 80 being restored, and ink is filled from the common flow passage 76 via the supply port 74 to the pressure chamber 72.

In the ink jet head 24, the nozzle surface 70B of a nozzle plate 70A has a lyophilic property. A method of lyophilization treatment includes a method of forming one or more liquid-repellent layers on at least a portion of the nozzle surface 70B of the nozzle plate 70A.

In addition, the structure of the ink jet head described with reference to FIGS. 6 to 8 is an example, and change, addition, or deletion is appropriately possible.

Description of Ink Supply System

Figure 9:
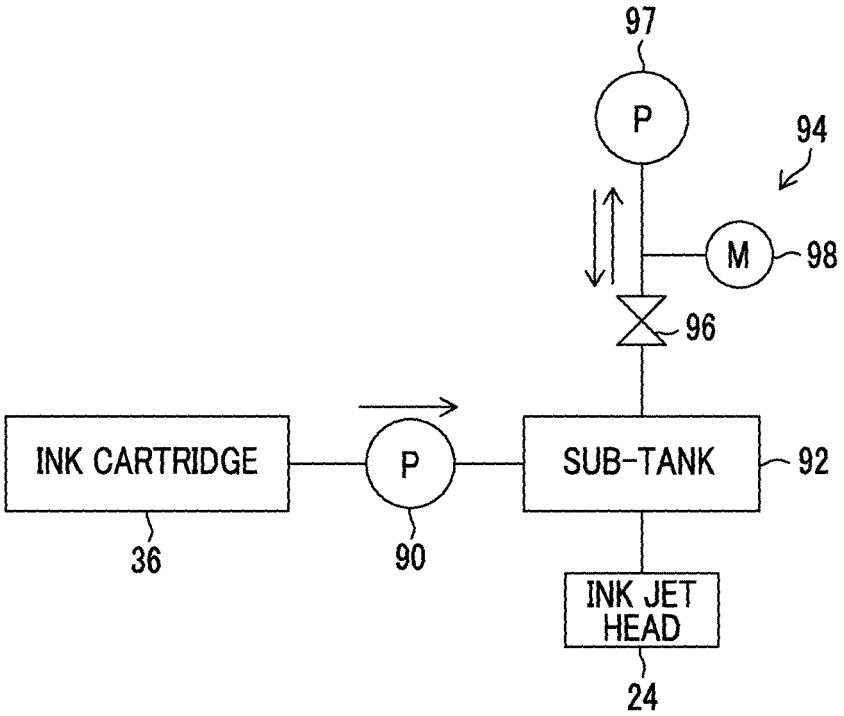
FIG. 9 is a block diagram illustrating the configuration of an ink supply system.

FIG. 9 is a block diagram illustrating the configuration of the ink supply system. The 3-dimensional structure of the ink jet system illustrated in FIG. 9 can be applied to any of the ink jet recording apparatus 10 illustrated in FIG. 2, the ink jet recording apparatus 10A illustrated in FIG. 3, the ink jet recording apparatus 10B illustrated in FIG. 5, and the ink jet recording apparatus to which the image forming method related to the second embodiment to be described below is applied.

As illustrated in FIG. 9, the ink contained in the ink cartridge 36 is sucked by a supply pump 90 and sent to the ink jet head 24 via a sub-tank 92. The sub-tank 92 is provided with a pressure adjustment unit 94 for adjusting the pressure of ink therein.

The pressure adjustment unit 94 has a pressurizing/decompressing pump 97 that communicates with the sub-tank 92 via a valve 96, a pressure gauge 98 provided between the valve 96 and the pressurizing/decompressing pump 97.

During image formation, the pressurizing/decompressing pump 97 operates in a direction in which the ink within the sub-tank 92 is suctioned, so that the internal pressure of the sub-tank 92 and the internal pressure of the ink jet head 24 are maintained at a negative pressure.

During the maintenance of the ink jet head 24, the pressurizing/decompressing pump 97 operates in a direction in which the ink within the sub-tank 92 is pressurized, so that the inside of the sub-tank 92 and the inside of the ink jet head 24 are forcibly pressurized and the ink within the ink jet head 24 is discharged via the nozzle. The ink forcibly discharged from the ink jet head 24 is contained in the ink receptacle of the cap that is not illustrated.

In the ink supply system illustrated in FIG. 9, the ink jet recording apparatus 10 illustrated in the present embodiment is adjusted such that the temperature of ink is kept within a certain range. A configuration example of keeping the temperature of ink constant includes an aspect in which a temperature sensor and a heater is provided in an ink flow passage for supplying ink from the sub-tank 92 to the ink jet head 24 to detect the temperature of ink within the sub-tank 92, and the heater is operated on the basis of the detection result of the temperature sensor.

In addition, the structure of the ink supply system illustrated in FIG. 9 is an example, and change, addition, or deletion is appropriately possible.

Description of Image Formation Mode

It is possible to apply the image formation control of the multi-path system to the ink jet recording apparatus 10 illustrated in the present embodiment and it is possible to change image formation resolution depending on a change in the number of scanning paths. For example, three types of image formation modes of a high-production mode, a standard mode, and a high-quality mode, are prepared, and the image formation resolution varies in the respective modes. The image formation modes can be selected according to the purpose and the application of image formation.

In the high-production mode, image formation is executed with a resolution of 600 dots per inch in the main scanning direction and at a resolution of 400 dots per inch in the sub-scanning direction. In the case of the high-production mode, a resolution of 600 dots per inch in the main scanning direction is realized by two paths that are twice scanning.

On an outward path of the carriage 30 that is first scanning, dots are formed at a resolution of 300 dots per inch. In a return path of the carriage 30 that is second scanning, dots are formed so as to interpolate the middle of the dots formed by the first scanning at 300 dots per inch, and a resolution of 600 dots per inch in the main scanning direction is obtained.

Nozzle pitch is 100 dots per inch in the sub-scanning direction, and dots are formed at a resolution of 100 dots per inch in the sub-scanning direction by one path that is single scanning. Hence, a resolution of 400 dots per inch is realized by performing by performing interpolation printing for filling a gap between nozzle pitches by four paths that are four scanning. In addition, the main scanning speed of the carriage 30 in the high-production mode is 1270 mm per second.

In the standard mode, image formation is executed at a resolution of 600 dots per inch in the main scanning direction and at a resolution of 800 dots per inch in the sub-scanning direction, and a resolution of 600 dots per inch in the main scanning direction and a resolution of 800 dots in the sub-scanning direction are obtained by two paths in the main scanning direction and eight paths in the sub-scanning direction.

In the high-quality mode, image formation is executed at a resolution of 1200 dots per inch in the main scanning direction and at a resolution of 1200 dots per inch in the sub-scanning direction, and a resolution of 1200 dots per inch in the main scanning direction and a resolution of 1200 dots in the sub-scanning direction are obtained by twelve paths in the main scanning direction and twelve paths in the sub-scanning direction.

In addition, the image formation modes exemplified herein are examples, and may include image formation modes excluding the above modes.

Swath Width by Shingling Scanning

In the image formation mode of a wide format machine, image formation conditions for shingling in each setting of resolution are determined. Specifically, since shingling image formation is carried out by splitting the whole length Lw of a nozzle row in the sub-scanning direction by the number of paths, the swath width varies depending on the whole length Lw of the nozzle row in the sub-scanning direction, the number of paths in the main scanning direction, and the number of paths in the sub-scanning direction.

The swath width assumed by image formation has a value obtained by splitting the whole length Lw of a nozzle row to be used in sub-scanning direction by the product of the number of paths in the main scanning direction and the number of paths in the sub-scanning direction.

For example, in an the ink jet head in which a plurality of nozzles are disposed in one row in the sub-scanning direction, In a case where the number of nozzles is 256, the distance between the nozzles is 100 dots per inch, the number of paths in the main scanning direction is 2, and the number of paths in the sub-scanning direction is 4, the whole length Lw of the nozzle row in the sub-scanning direction is 64.8 mm. As a result, the swath width is 8.1 mm that is a value obtained by dividing 64.8 mm, which is the whole length Lw of the nozzle row in the sub-scanning direction, by a total number of eight paths.

In the intermittent transport of a medium in the sub-scanning direction, a transport distance in single intermittent transport is the swath width. If intermittent transport equivalent to the total number of paths is performed, image formation is carried out over a length equivalent the whole length Lw of the nozzle row in the sub-scanning direction.

In addition, the intermittent transport of a medium in the sub-scanning direction exemplified herein is illustrative, and transport control excluding the above may be applied.

Working Effects of First Embodiment

According to the ink jet recording apparatus 10 related to the first embodiment configured as above, in a case where a medium exceeding the transport limit of the first transport unit 150 is used, the second transport unit 170 can be used to assist in the medium transport performed by the first transport unit 150. Since the second transport unit 170 performs medium transport on the basis of the driving signal applied to the driving control of the first motor 158 that is the driving source of the first transport unit 150, even in a case where a medium exceeding the transport limit of the first transport unit 150 is used, it is possible to realize medium transport in which the synchronization with the image formation is taken, as in a case where a medium equal to or lower than the transport limit of the first transport unit 150 is used.

Additionally, by configuring the optional device 21 configured to include the second transport unit 170, the second driving unit 171, and the second motor driver 190, switching becomes easy in which the optional device 21 is attached and image formation is performed in a case where a medium exceeding the transport limit of the first transport unit 150 is used, and the optional device 21 is removed and image formation is performed in a case where a medium equal to or lower than the transport limit of the first transport unit 150 is used.

Second Embodiment

Next, an image forming method related to a second embodiment of the invention will be described. In the second embodiment to be described below, the same components as those of the first embodiment will be designated by the same reference signs, and the description thereof will be appropriately omitted.

Outline

For example, in a case where the medium 12 with a heavy weight of several kilograms or more is transported by the first transport unit 150 illustrated in FIG. 2, a delay may occur in the start of movement of the medium 12 with respect to the start of movement of the grid roller 40B. Similarly, a phenomenon occurred in which the stop of the medium 12 is delayed to the stop of the grid roller 40B and was excessively advanced.

Also, it was found that a delay occurs in the movement of the medium 12 with respect to the driving of the grid roller 40B so that unevenness occurs in units of the swath width in a formed image.

Thus, in the image forming method illustrated in the present embodiment, medium transport is performed using the second transport unit 170 that assists in the medium transport of the first transport unit 150, and with respect to the medium transport control of the second transport unit 170, a transport acceleration correction coefficient, a transport start preceding period, a correction start transport speed, and a transport speed correction coefficient are set as medium transport control parameters.

As a medium transport control parameter setting unit that sets the medium transport control parameters, the input device 120 of FIG. 4 can be applied. The medium transport control parameter setting unit is one aspect of medium transport control parameter setting means.

The transport acceleration correction coefficient is a correction coefficient of the transport acceleration of the second transport unit 170 with respect to the medium transport acceleration of the first transport unit 150, and a value exceeding 0 and less than 1 is set. That is, the transport acceleration of the first transport unit 150 is made to be equal to or lower than the transport acceleration of the second transport unit 170.

By setting the transport acceleration correction coefficient, the slip between the second transport unit 170 and the medium 12 is prevented, and the transport position deviation of the medium 12 when sending a medium from the second transport unit 170 to the first transport unit 150 is prevented.

As the transport start preceding period, a period in which the driving start of the second transport unit 170 is made to precede the driving start timing of the first transport unit 150 is set. 0 or more values are set as the transport start preceding period.

By making the driving start of the second transport unit 170 precede the driving start of the first transport unit 150, the transport position deviation of the medium 12 when a medium from the second transport unit 170 to the first transport unit 150 is prevented.

The correction start transport speed is a medium transport speed of the second transport unit 170 at which the correction of the medium transport speed of the second transport unit 170 is started, and calculated by multiplying an image formation medium transport speed by a value exceeding 0 and less than 1 value. For example, if a coefficient by which the image formation medium transport speed is multiplied is 0.9, the correction of the medium transport speed of the second transport unit 170 is performed at a timing when the medium transport speed of the second transport unit 170 has reached 90% of a maximum value of the image formation transport speed.

The image formation transport speed is a maximum value of the medium transport speed when the medium 12 is intermittently transported by the first transport unit 150 in a period in which image formation is executed.

By setting the correction start transport speed, the transport position deviation of the medium 12 when sending a medium from the second transport unit 170 to the first transport unit 150 is prevented.

The transport speed coefficient represents the ratio of the transport speed of the second transport unit 170 to the image formation transport speed, and a value exceeding 0 and less than 1 value by which the image formation transport speed is multiplied is set. That is, the transport speed of the second transport unit 170 is made to be equal to or lower than the transport speed of the first transport unit 150.

By making the medium transport speed of the second transport unit 170 slower than the medium transport speed of the first transport unit 150, the transport position deviation of the medium 12 when sending the medium 12 from the second transport unit 170 to the first transport unit 150 is prevented.

Description of Flowchart

Figure 10:
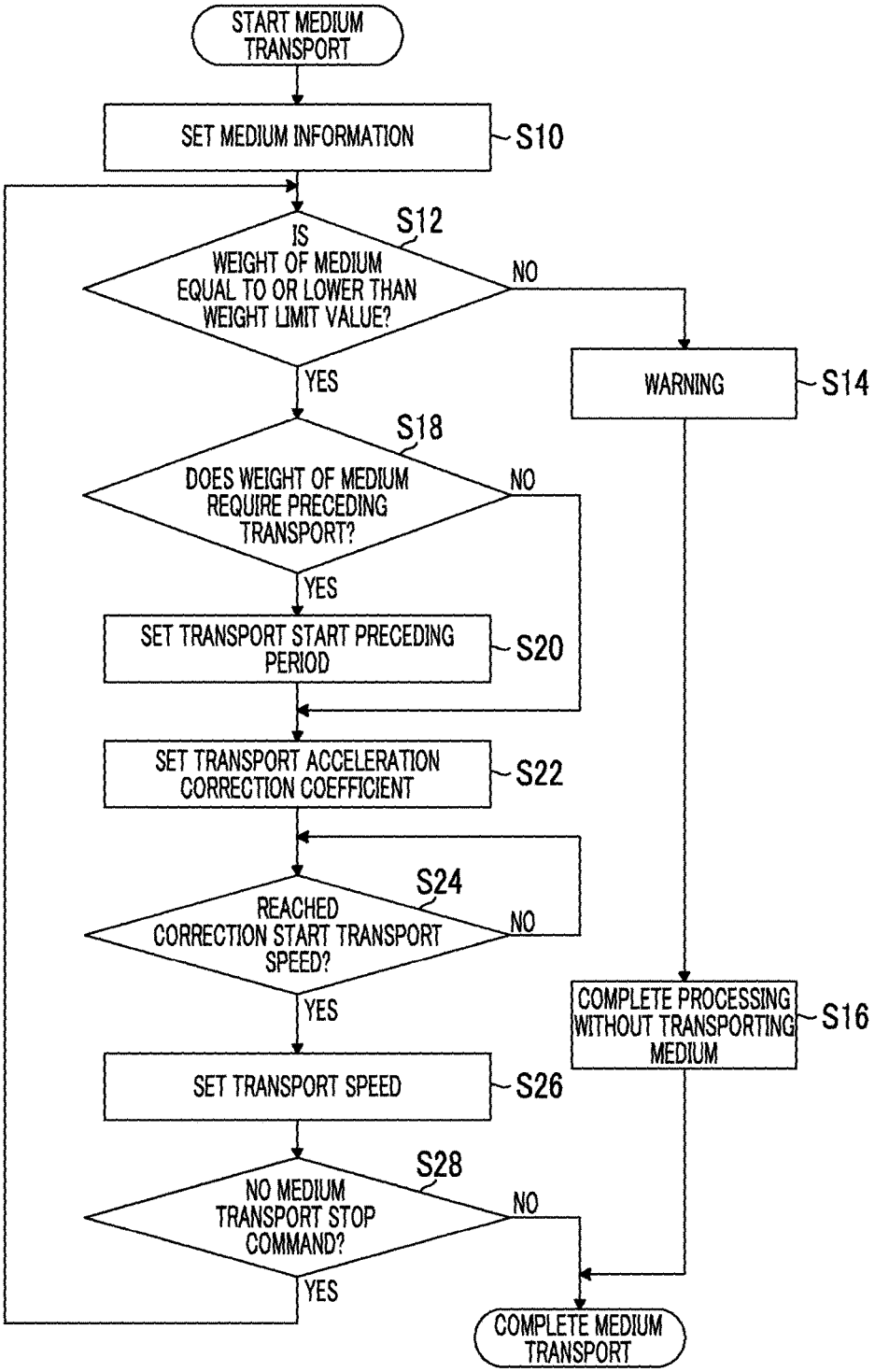
FIG. 10 is a flowchart illustrating the flow of control of an image forming method related to a second embodiment of the invention.

FIG. 10 is a flowchart illustrating the flow of control of the image forming method related to the second embodiment of the invention. The flow of control of the image forming method related to the second embodiment will be described below, describing a correspondence relationship with the control system illustrated in FIG. 4.

If the medium transport control of FIG. 10 is started, medium information is set in a medium information setting step S10. In the medium information setting step S10, information on the medium 12 is set using the medium information setting unit 121 illustrated in FIG. 4.

The processing proceeds to a medium weight determination step S12, and is determined whether or not the weight of a medium is equal to or lower than the weight limit of the first transport unit 150. Information on the weight of the medium is ascertained from the medium information set in the medium information setting step S10. For example, as for the weight of the medium, it is possible to ascertain the type of the medium from the acquired medium information and read the weight of the medium from a table showing a relationship between the type of media and the weight of the media.

In a case where the weight of the medium is read from the table showing the relationship between the type of media and the weight of the media, a table showing the relationship between the type of media and the weight of media are prepared in advance and is stored in the information storage unit 124 of FIG. 4.

A weight detecting unit that detects the weight of a medium may be provided at a preceding stage of the second transport unit 170 illustrated in FIG. 2, and a detection result obtained by the weight detecting unit may be used.

In a case where the weight of the medium is equal to or lower than the weight limit of the first transport unit 150 illustrated in FIG. 2 from which YES is determined in the medium weight determination step S12 of FIG. 10, the processing proceeds to a preceding transport requirement determination step S18. In the preceding transport requirement determination step S18, whether or not preceding transport is required is determined on the basis of the weight of the medium 12.

In a case where the preceding transport is not required from which NO is determined in the preceding transport requirement determination step S18, the processing proceeds to the transport acceleration setting step S22. In a case where the preceding transport is required from which YES is determined in the preceding transport requirement determination step S18, the processing proceeds to a transport start preceding period setting step S20.

In a case where the weight of the medium exceeds the weight limit of the first transport unit 150 illustrated in FIG. 2 from which NO is determined in the medium weight determination step S12 of FIG. 10, the processing proceeds to a warning step S14 of FIG. 10. In the warning step S14, a warning is issued to the effect that the weight of the medium exceeds the weight limit of the first transport unit 150 illustrated in FIG. 2.

If a warning is issued in the warning step S14 of FIG. 10, the processing proceeds to a medium non-transport completion step S16. In the medium non-transport completion step S16, completion processing is executed without transporting the medium 12.

In the transport start preceding period setting step S20, a period in which the driving start timing of the second transport unit 170 is made to precede the driving start timing of the first transport unit 150 illustrated in FIG. 2 is set.

If the transport start preceding period is set in the transport start preceding period setting step S20 of FIG. 10, the processing proceeds to the transport acceleration setting step S22. In the transport acceleration setting step S22, a value obtained by multiplying the transport acceleration of the first transport unit 150 illustrated in FIG. 2 by the transport acceleration correction coefficient set in advance is set to the transport acceleration of the second transport unit 170.

The transport acceleration correction coefficient may be a fixed value, or may be changed according to the weight of the medium 12 determined in the medium weight determination step S12 of FIG. 10. Additionally, the transport acceleration correction coefficient may be changed depending on whether or not there is a medium exceeding the weight limit of the first transport unit 150 illustrated in FIG. 2.

If the driving of the first transport unit 150 and the second transport unit 170 illustrated in FIG. 2 is started through the transport start preceding period setting step S20 and the transport acceleration setting step S22 of FIG. 10, whether or not the transport speed of the second transport unit 170 illustrated in FIG. 2 has reached the correction start transport speed is determined in the correction start transport speed determination step S24 of FIG. 10.

The correction start transport speed may be a fixed value, or may be changed according to the weight of the medium 12 determined in the medium weight determination step S12. Additionally, the correction start transport speed may be changed depending on whether or not there is a medium exceeding the weight limit of the first transport unit 150 illustrated in FIG. 2.

If it is determined that the transport speed of the second transport unit 170 has not reached the correction start transport speed from which NO is determined in the correction start transport speed determination step S24, a determination on whether or not the transport speed of the second transport unit 170 has reached the correction start transport speed is repeatedly made in the correction start transport speed determination step S24.

If it is determined that the transport speed of the second transport unit 170 illustrated in FIG. 2 has reached the correction start transport speed from which YES is determined in the correction start transport speed determination step S24, the processing proceeds to a transport speed setting step S26 of FIG. 10. A value obtained by multiplying the image formation transport speed by the transport speed correction coefficient is set to the transport speed of the second transport unit 170 illustrated in FIG. 2.

The transport speed correction coefficient may be changed depending on whether or not there is a medium exceeding the weight limit of the first transport unit 150 illustrated in FIG. 2.

If medium transport is started, the presence/absence of a transport stop command is determined in a stop command determination step S28 of FIG. 10. The medium transport is completed in a case where the transport stop command is issued from which NO is determined in the stop command determination step S28.

In a case where the transport stop command is not issued from which YES is determined in the stop command determination step S28, the medium transport is continued, and the processing proceeds to the medium weight determination step S12.

In addition, the medium transport control parameters of the second transport unit 170 are not limited to the above four types, and may be appropriately added and deleted.

Figure 11:
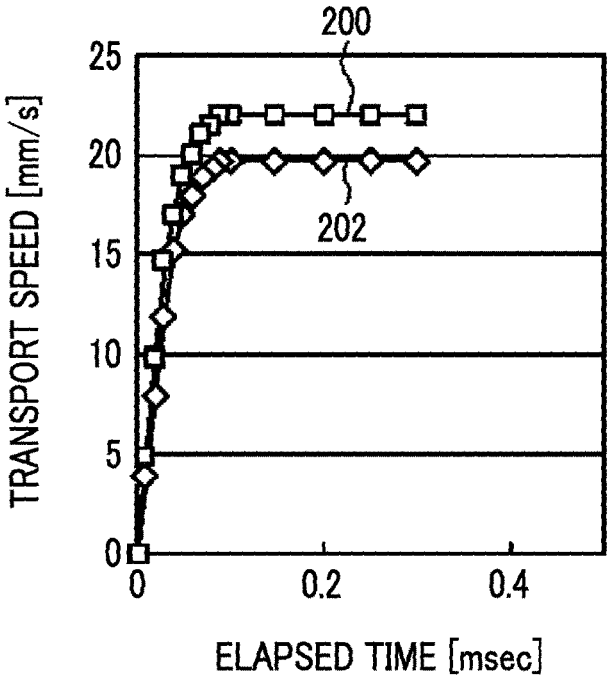
FIG. 11 is an explanatory view illustrating a relationship between the transport control of a first transport unit and the transport control of a second transport unit for solving the transport unevenness between the first transport unit and the second transport unit.
Figure 12:
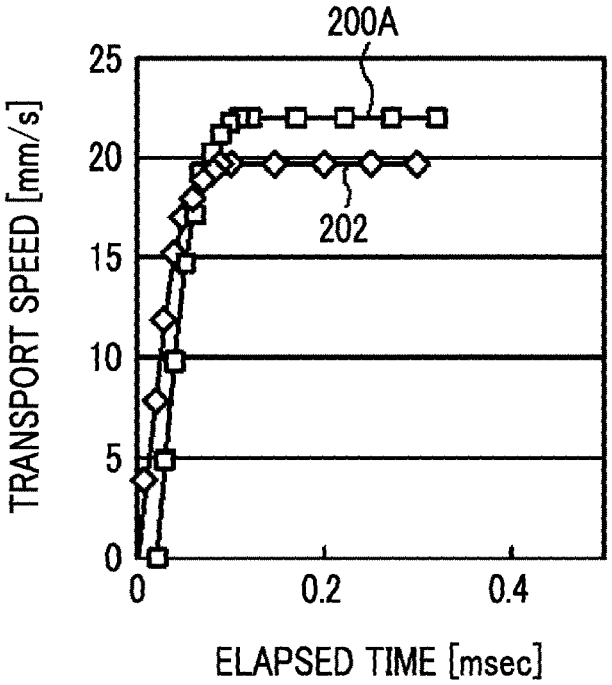
FIG. 12 is an explanatory view illustrating a relationship between the transport control of the first transport unit and the transport control of the second transport unit for solving the transport unevenness between the first transport unit and the second transport unit in case where a rigid medium is used.
Figure 13:
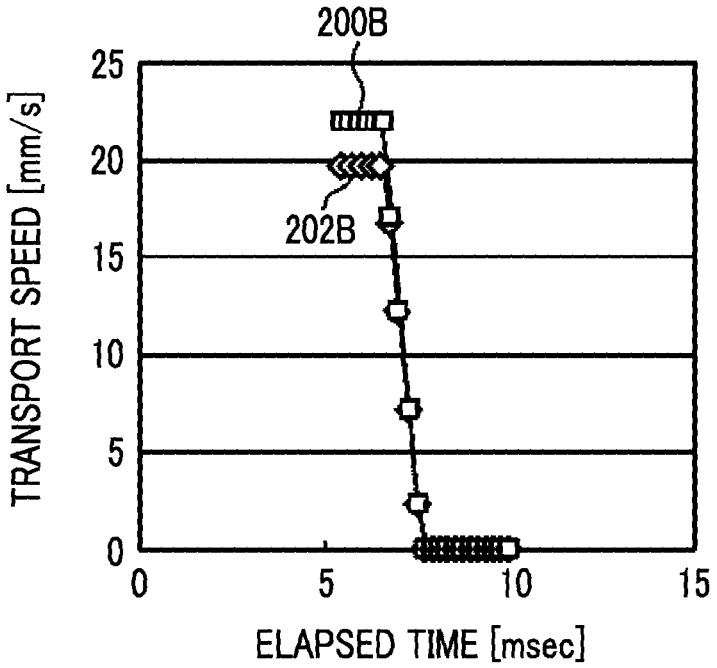
FIG. 13 is an explanatory view of the effects of the transport control.

FIGS. 11 to 13 are explanatory views of the medium transport control related to the second embodiment. FIG. 11 is an explanatory view illustrating relationships between elapsed periods from the driving start timings and the transport speeds in the first transport unit and the second transport unit, in a case where a transport acceleration coefficient, the correction start transport speed, and the transport speed correction coefficient are set.

Reference sign 200 of FIG. 11 designates a relationship between an elapsed period from the driving start timing of the first transport unit 150 and the medium transport speed illustrated in FIG. 2. Reference sign 202 of FIG. 11 designates a relationship between an elapsed period from the driving start timing of the second transport unit 170 and the medium transport speed illustrated in FIG. 2.

In the medium transport control illustrated in FIG. 11, the transport acceleration of the second transport unit 170 illustrated in FIG. 2 is set to 0.8 times the transport acceleration of the first transport unit 150. Additionally, the correction start transport speed is set to 0.9 times the image formation transport speed, and the transport speed of the second transport unit 170 is set to 0.9 times the image formation transport speed.

FIG. 12 is an explanatory view illustrating relationships between elapsed periods from driving start timings and transport speeds in the first transport unit and the second transport unit in a case where the transport start preceding period is set. FIG. 12 illustrates relationships between elapsed periods from the driving start timings and the transport speeds in the first transport unit and the second transport unit in a case where the transport start preceding period is 0.02 seconds in addition to the above setting.

Reference sign 200A of FIG. 12 designates a relationship between an elapsed period from the driving start timing of the second transport unit 170 illustrated in FIG. 2 and the medium transport speed. Reference sign 202 of FIG. 12 designates a relationship between an elapsed period from the driving start timing of the first transport unit 150 and the medium transport speed illustrated in FIG. 2, and is the same as that of FIG. 11.

FIG. 13 is an explanatory view illustrating a relationship between elapsed periods from the driving start timings and the transport speeds in the first transport unit and the second transport unit in the vicinity of a medium transport stop timing. Reference sign 200B of FIG. 13 designates a relationship between an elapsed period from the driving start timing of the second transport unit 170 and the medium transport speed illustrated in FIG. 2. Reference sign 202B of FIG. 13 designates a relationship between an elapsed period from the driving start timing of the first transport unit 150 and the medium transport speed illustrated in FIG. 2.

As illustrated in FIG. 13, the driving stop timings of the first transport unit 150 and the second transport unit 170 are made to coincide with each other.

That is, when a medium having a weight of several kilograms or more is transported, the transport acceleration correction coefficient, the transport start preceding period, the correction start transport speed, and the transport speed correction coefficient are set as the medium transport control parameters of the second transport unit 170, and thus, a medium transport start timing of the second transport unit 170 is made to slightly precede the medium transport start timing of the first transport unit 150, and the medium transport stop of the first transport unit 150 is made to coincide with the medium transport stop of the second transport unit 170, and thus, the transport unevenness of the medium 12 intermittently transported by both of the first transport unit 150 and the second transport unit 170 is prevented and occurrence of stop position deviation at each stop position is prevented.

Although an aspect in that one type of transport acceleration correction coefficient, transport start preceding period, correction start transport speed, and transport speed correction coefficient are set as the medium transport control parameters is exemplified in the present example, a plurality of types of transport acceleration correction coefficients, transport start preceding periods, correction start transport speeds, and transport speed correction coefficients according to the weight of a medium may be determined, and these may be appropriately switched according to the weight of the medium.

Working Effects of Second Embodiment

According to the image forming method related to the second embodiment, the transport acceleration correction coefficient, the transport start preceding period, the correction start transport speed, and the transport speed correction coefficient are set as the medium transport control parameters regarding the second transport unit 170, and the driving control of the second motor 186 that is a driving source of the second transport unit 170 is corrected. By correcting the driving control of the second motor 186 according to the weight of the medium 12, the transport position deviation of the medium 12 is prevented, and occurrence of unevenness of the units of the swath width in a formed image is suppressed.

Application Example of Speed Reducer

Next, an application example of the speed reducer will be described. The speed reducer related to the present application example can be applied to the second gear 182 illustrated in FIG. 2. In the following description, the same components as the components described up to now will be designated by the same reference signs, and the description thereof will be appropriately omitted.

The driving of the second motor 186 that becomes the driving source of the second transport unit 170 illustrated in FIG. 2 is controlled using the driving signal applied to the driving control of the first motor 158 that is the driving source of the first transport unit 150. The second transport unit 170 may decelerate the transport speed compared to synchronous transport based on the driving signal applied to the driving control of the first motor 158. Moreover, it is preferable that the reduction ratio of the second gear 182 coupled to the second transport unit 170 can be adjusted in a stepless manner. An endless variable speed reducer configured such that the speed thereof is made variable in a stepless manner will be described below.

Figure 14A:
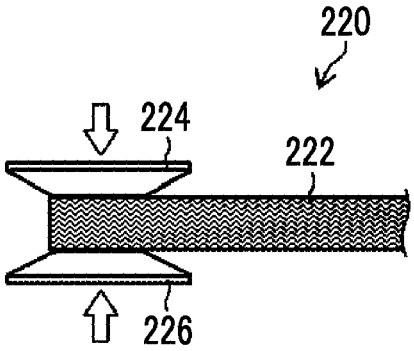
FIG. 14A is a top view of a belt-type reduction ratio variable mechanism.
Figure 14B:
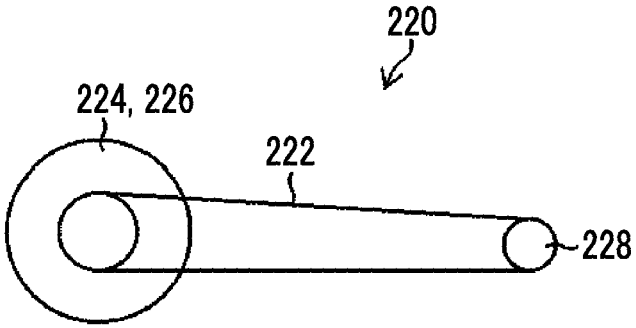
FIG. 14B is a side view of the belt-type reduction ratio variable mechanism.

FIG. 14A is a top view of a belt-type stepless variable speed reducer. FIG. 14B is a side view of the belt-type stepless variable speed reducer. FIGS. 14A and 14B illustrates a state where the reduction ratio is a lower limit of a variable range.

The belt-type stepless variable speed reducer 220 illustrated in FIGS. 14A and 14B is constituted of a belt 222, a first variable diameter pulley 224, and a second variable diameter pulley 226. The first variable diameter pulley 224 and the second variable diameter pulley 226 have a truncated conical shape. The first variable diameter pulley 224 and the second variable diameter pulley 226 are coupled together such that their respective upper surfaces face each other.

An endless belt 222 is wound around a coupling part between the first variable diameter pulley 224 and the second variable diameter pulley 226. A member illustrated with reference sign 228 in FIG. 14B is a pulley that is coupled to the rotary shaft 191 of the second motor 186 illustrated in FIG. 2.

Figure 15A:
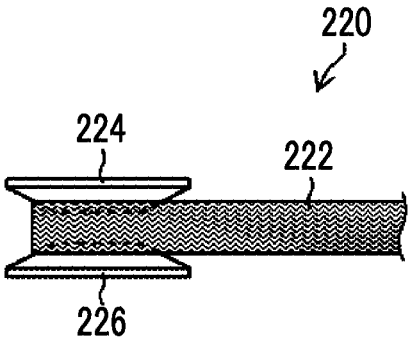
FIG. 15A is a top view of the belt-type reduction ratio variable mechanism.
Figure 15B:
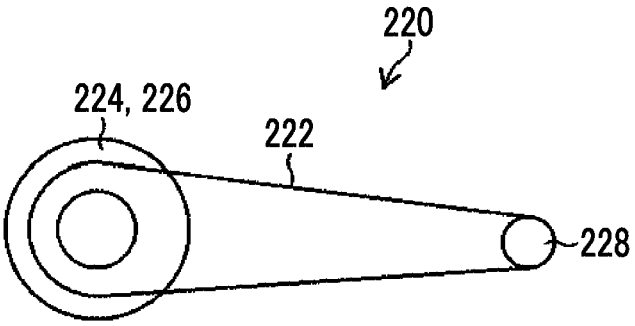
FIG. 15B is a side view of the belt-type reduction ratio variable mechanism.

FIG. 15A is a top view about a belt-type stepless variable speed reducer. FIG. 15B is a side view of the belt-type stepless variable speed reducer. FIGS. 15A and 15B illustrates a state where the reduction ratio is in the middle of the variable range.

By making the distance of the first variable diameter pulley 224 and the second variable diameter pulley 226 short, the reduction ratio can be made relatively large.

Figure 16A:
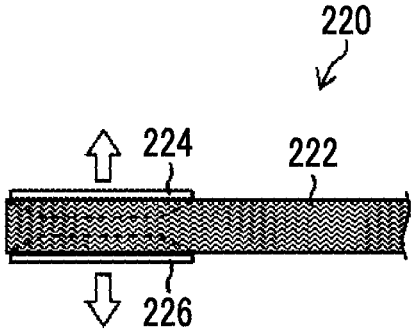
FIG. 16A is a top view of the belt-type reduction ratio variable mechanism.
Figure 16B:
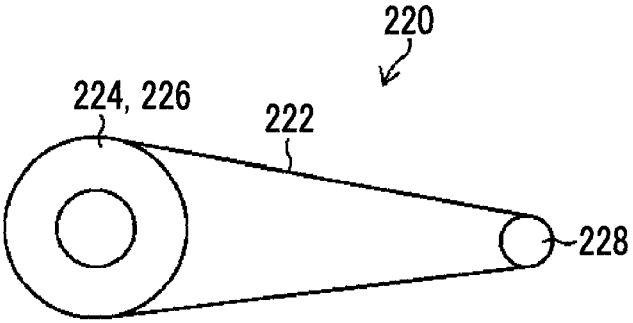
FIG. 16B is a side view of the belt-type reduction ratio variable mechanism.

FIG. 16A is a top view about a belt-type stepless variable speed reducer. FIG. 16B is a side view of the belt-type stepless variable speed reducer. FIGS. 16A and 16B illustrates a state where the reduction ratio is an upper limit of the variable range.

By applying the variable diameter pulleys 224 and 226 illustrated in FIG. 14A to FIG. 16B the second gear 182 of FIG. 2, the reduction ratio of the second transport unit 170 to the first transport unit 150 can be made variable in a stepless manner.

Figure 17:
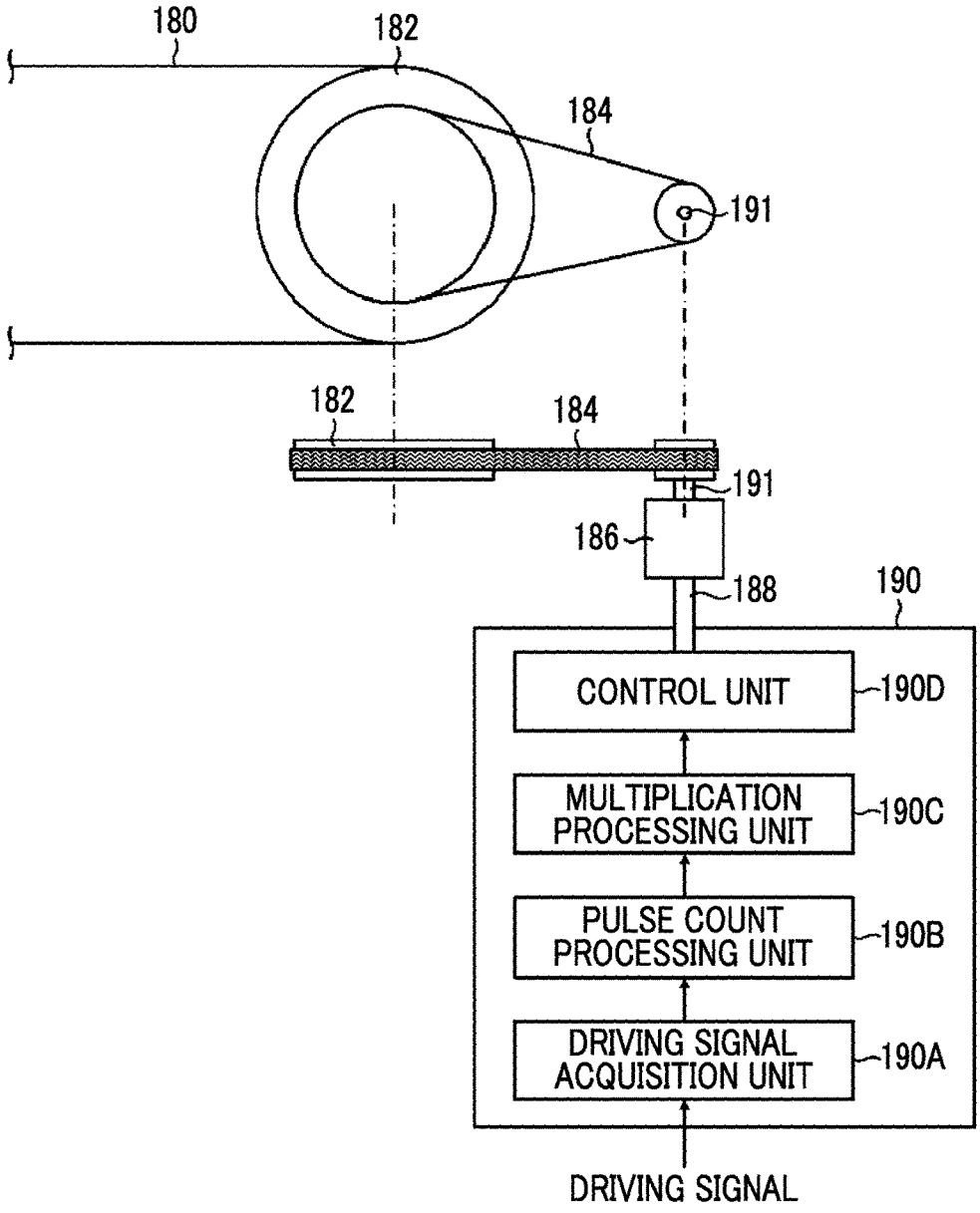
FIG. 17 is an explanatory view of an electronic reduction ratio variable mechanism.

FIG. 17 is an explanatory view of an electronic stepless variable speed reduction mechanism. A schematic view of the second gear 182, the fifth belt 184, and the rotary shaft 191 of the second motor 186 are seen from a side and a schematic view of the second gear 182, the fifth belt 184, and the rotary shaft 191 of the second motor 186 as seen from the top are illustrated together in FIG. 17.

The electronic stepless variable speed reduction mechanism illustrated in FIG. 17 performs signal processing on the biphasic pulse signal output from the encoder attached to the first motor 158 as the driving signal, to change the driving of the second motor 186.

As illustrated in FIG. 17, the second motor driver 190 has a driving signal acquisition unit 190A, a pulse count processing unit 190B, a multiplication processing unit 190C, and a control unit 190D. By performing processing, such as multiplication processing, on the driving signal, the driving control of the second motor 186 is changed in correspondence with a reduction ratio that should be set for the second motor 186.

According to the electronic stepless variable speed reduction mechanism illustrated in FIG. 17, it is possible to adjust the reduction ratio of the second transport unit 170 to the first transport unit 150 without changing the configuration of the second driving unit 171.

Detection of Parallelism

Figure 18:
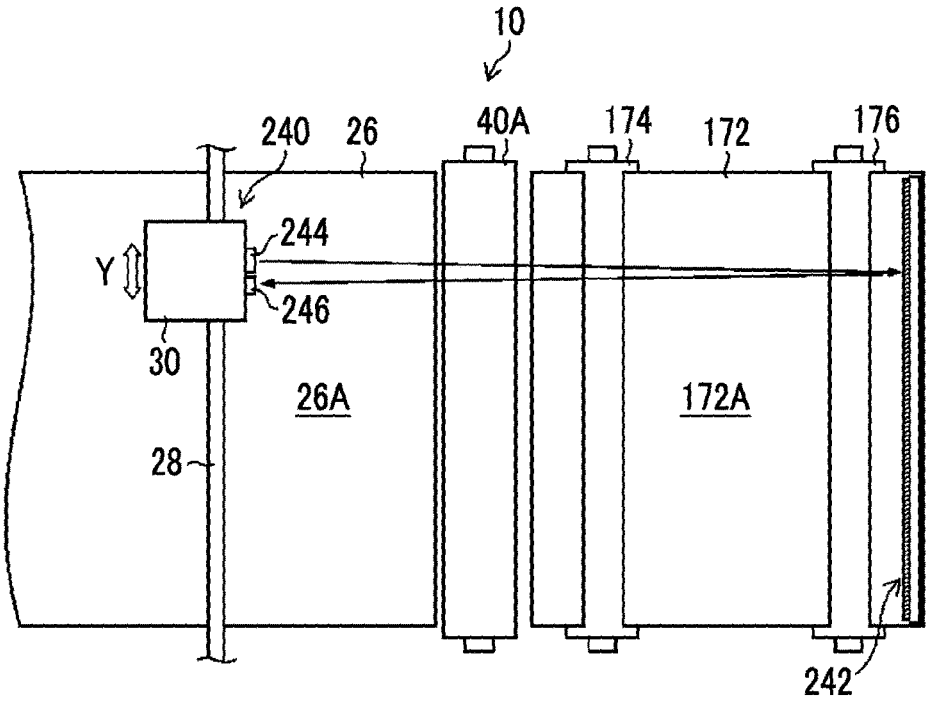
FIG. 18 is a schematic view of parallelism detection.
Figure 19:
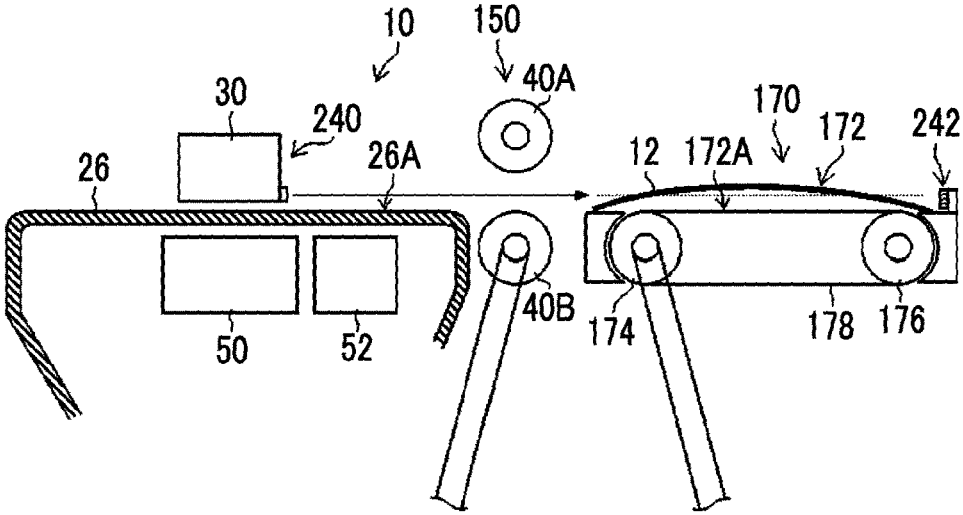
FIG. 19 is a side view of the configuration of the parallelism detection illustrated in FIG. 18.

FIG. 18 is a schematic view of the parallelism detection. FIG. 18 is a block diagram of the ink jet recording apparatus 10 illustrated in FIG. 1 and the like as seen from the top. FIG. 19 is a side view of the configuration of the parallelism detection illustrated in FIG. 18. In the following description, the same components as the components described up to now will be designated by the same reference signs, and the description thereof will be appropriately omitted.

As illustrated in FIGS. 18 and 19, the carriage 30 includes an optical sensor 240, and a reflecting surface 242 for the light radiated from the optical sensor 240 is disposed at the end of the second transport unit 170 on the driven roller 176 side.

The optical sensor 240 includes a light beam radiation part 244 that radiates a laser beam that is a reference light beam toward the reflecting surface 242 within a plane parallel to the first support surface 26A of the platen 26, and a light-receiving part 246 that receives the laser beam reflected by the reflecting surface 242. In FIGS. 18 and 19, radiated light and reflected light are illustrated using arrow lines.

The optical sensor 240 and the reflecting surface 242 are constituent elements of one aspect of parallelism detecting means. The light beam radiation part 244 is equivalent to light beam radiation means.

By radiating a laser beam while making the carriage 30 perform scanning in the scanning direction Y, receiving the reflected light reflected by the reflecting surface 242, and analyzing an output signal from the optical sensor 240, the parallelism of the second support surface 172A of the conveyor 172 can be confirmed.

As the optical sensor 240, the laser sensor E3NC-LH03 made by OMRON Corp. can be applied. By disposing the light beam radiation part 244 on the carriage 30, the parallelism can be detected in the total range of the scanning range of the ink jet head 24.

In a case where the parallelism of the second support surface 172A of the conveyor 172 is determined to be out of an allowable range, the adjustment of the parallelism of the second support surface 172A of the conveyor 172 is performed. The deviation amount of the parallelism of the second support surface 172A of the conveyor 172 from a central value may be calculated and the deviation amount may be automatically corrected, or the deviation amount may be displayed and may be manually adjusted.

Torsion of the medium 12 during transport is prevented by performing the detection and the adjustment of this parallelism.

A configuration in which the parallelism is automatically adjusted is one aspect of parallelism adjustment means. A configuration in which the deviation amount is displayed, an operating member that is manually operated, and an adjustment function of the parallelism are one aspect of the parallelism adjustment means.

As illustrated in FIG. 19, the warping of the medium 12 that becomes a hindrance to image formation or the like can be detected by adjusting the height of the optical sensor 240 to an upper limit of the allowable range of the warping or floating of the medium 12. The height of the optical sensor 240 is a distance between the radiation position and the light-receiving position of the optical sensor 240 and the first support surface 26A of the platen 26.

In a state where the medium 12 is placed on the second support surface 172A of the conveyor 172, a laser beam is radiated while making the carriage 30 perform scanning in the scanning direction Y, and the reflected light reflected by the reflecting surface 242 is received. In a case where the warping or the like of the medium 12 exceeds the conditions of the allowable range, both the radiated light and the reflected light are blocked by a floating portion of the medium 12. Thus, it is possible to analyze the output signal from the optical sensor 240, thereby determining the presence/absences of the warping or the like of the medium 12.

Additionally, by adjusting the distance between the ink jet head 24 and the first support surface 26A of the platen 26 according to the degree of the warping or the like of the medium 12, the collision between the ink jet head 24 and the medium 12 is prevented. Additionally, by disposing the light beam radiation part 244 on the carriage 30, the warping of the medium 12 can be detected in the total range of the scanning range of the ink jet head 24.

A configuration may be adopted in which a plurality of detecting elements are disposed on the reflecting surface 242, and the parallelism of the first support surface 26A of the platen 26, the parallelism of the second support surface 172A of the conveyor 172, the presence/absences of the warping or the like of the medium 12, and the position of the warping or the like of the medium 12 can be determined on the basis of output signals obtained from the detecting elements.

Additionally, a configuration may be adopted in which an optical system, such as lenses, are disposed on an entire radiation surface of the light beam radiation part 244, and the light flux, the light diameter, and the like of radiated light are adjusted.

Static Electricity Countermeasure

A reference potential of the first transport unit 150, the first driving unit 151, and the first motor driver 162 and a reference potential of the second transport unit 170, the second driving unit 171, and the second motor driver 190 are electrically connected to each other via reference potential connection wiring lines, as shown in FIG. 5, and become the same potential.

By virtue of this electrical configuration, the static electricity generated by the contact or separation between a medium accompanying medium transport and the second transport unit 170 can be released to the reference potential of the first transport unit 150, the first driving unit 151, and the first motor driver 162.

Medium

Those referred to as various terms, such as recording media, media to be recorded, printing media, media to be printed, image forming media, media to be image-formed, image receiving media, media to be discharged, paper, recording paper, printing paper, and substrates are included in the medium.

Combination of Embodiment

It is possible to adopt a configuration in which the configurations described as the above-described embodiment and modification examples are appropriately combined together.

Application Example to Method Invention

It is also possible to configure a method invention including steps corresponding to the respective parts of the apparatus described above. For example, an image forming method including a first driving step of driving the first driving unit 151, a second driving step of driving the second driving unit 171, and a driving signal output step of outputting a driving signal can be configured in correspondence with the ink jet recording apparatus 10 described in the first embodiment.

In the embodiments and the modification examples of the invention described above, the constituent elements can be appropriately changed, added, or eliminated without departing from the scope of the invention. The invention is not limited to the embodiments described above, and many alterations are possible by a person having ordinary knowledge in this art in question within the technical idea of the invention.

EXPLANATION OF REFERENCES

10, 10A: ink jet recording apparatus
12: medium
24: ink jet head
26: platen
26A: first support surface
28: guide mechanism
30: carriage
40A: pinch roller
40B: grid roller
102: control device
104: transport control unit
115: first encoder
150: first transport unit
151: first driving unit
154: first gear
158: first motor
161, 161A: first driving signal transmission wiring line
162: first motor driver
166: driving signal output terminal
170: second transport unit
171: second driving unit
172: conveyor
172A: second support surface
174: driving roller
182: second gear
186: second motor
190: second motor driver
194: driving signal input terminal

What is claimed is:

1. An image forming apparatus comprising:

first transport means for pinching a medium between a first roller and a second roller and driving at least any one of the first roller or the second roller to transport the medium;

image forming means for forming an image on the transported medium;

first driving means for driving at least any one of the first roller or the second roller, the first driving means including first coupling means coupled to at least any one of the first roller or the second roller, and a first driving source coupled to at least any one of the first roller or the second roller via the first coupling means;

first driving control means for controlling the driving of the first driving means;

driving signal output means for outputting a driving signal to be applied to the control of the driving of the first driving means;

second transport means disposed on at least any one of an upstream side or a downstream side of the image forming means in a medium transport direction for assisting in the transport of the medium by the first transport means;

second driving means for driving the second transport means;

second driving control means for controlling the driving of the second driving means; and driving signal transmission means for transmitting a driving signal, which is output from the driving signal output means, to the second driving control means; and a medium fixing plate to which the medium is fixed, wherein the second driving control means controls the driving of the second driving means using the driving signal transmitted by the driving signal transmission means, wherein the second transport means is provided on the upstream side and the downstream side of the image forming means in the medium transport direction, and wherein the medium fixing plate has a length over the second transport means provided on the upstream side and the downstream side of the image forming means in the medium transport direction.

2. An image forming apparatus comprising:

first transport means for pinching a medium between a first roller and a second roller and driving at least any one of the first roller or the second roller to transport the medium;

image forming means for forming an image on the transported medium;

first driving means for driving at least any one of the first roller or the second roller, the first driving means including first coupling means coupled to at least any one of the first roller or the second roller, and a first driving source coupled to at least any one of the first roller or the second roller via the first coupling means;

first driving control means for controlling the driving of the first driving means;

driving signal output means for outputting a driving signal to be applied to the control of the driving of the first driving means;

second transport means disposed on at least any one of an upstream side or a downstream side of the image forming means in a medium transport direction for assisting in the transport of the medium by the first transport means;

second driving means for driving the second transport means;

second driving control means for controlling the driving of the second driving means; and driving signal transmission means for transmitting a driving signal, which is output from the driving signal output means, to the second driving control means;

medium supporting means having a first support surface that supports the medium in an image formation region of the image forming means;

parallelism detecting means for detecting the parallelism of a second support surface that is a surface of the second transport means which supports the medium, the parallelism detecting means including light beam radiation means for radiating a light beam serving as a reference within a plane parallel to the first support surface; and parallelism adjustment means for adjusting the parallelism of the second support surface on the basis of a detection result of the parallelism detecting means, wherein the second driving control means controls the driving of the second driving means using the driving signal transmitted by the driving signal transmission means.

3. The image forming apparatus according to claim 2, wherein the parallelism detecting means detects the warping of the medium supported by the second support surface.

4. The image forming apparatus according to claim 2, wherein the image forming means includes a head that forms an image on the medium, and scanning means for making the head perform scanning in a direction orthogonal to the medium transport direction, and wherein the light beam radiation means is disposed in the scanning means.

5. The image forming apparatus according to claim 1, wherein the driving signal output means is an encoder attached to the first driving source, and wherein the driving signal transmission means transmits a pulse signal, which is output from the encoder, to the second driving control means.

6. The image forming apparatus according to claim 5, wherein the driving signal transmission means includes a first driving signal transmission wiring line that transmits the driving signal output from the encoder, a driving signal output terminal provided in the first driving control means and connected to the first driving signal transmission wiring line, a second driving signal transmission wiring line connected to the driving signal output terminal, and a driving signal input terminal provided in the second driving control means and connected to the second driving signal transmission wiring line.

7. The image forming apparatus according to claim 5, wherein the driving signal transmission means includes a first driving signal transmission wiring line that transmits the driving signal output from the encoder, and a driving signal input terminal provided in the second driving control means and connected to the first driving signal transmission wiring line.

8. The image forming apparatus according to claim 1, wherein the second driving means includes second coupling means coupled to the second transport means, and a second driving source that is coupled to the second transport means via the second coupling means and whose driving is controlled by the second driving control means on the basis of the driving signal.

9. The image forming apparatus according to claim 8, wherein the second coupling means includes a stepless variable speed reducer configured to be capable of adjusting a reduction ratio in a stepless manner, and wherein the second driving control means adjusts the reduction ratio of the stepless variable speed reducer.

10. The image forming apparatus according to claim 8, wherein the second driving control means controls the driving of the second driving source in correspondence with a reduction ratio to be set for the second driving source on the basis of the driving signal.

11. The image forming apparatus according to claim 1, wherein the first transport means, the first driving means, the first driving control means, the image forming means, and the driving signal output means are housed in a main body unit, wherein the second transport means, the second driving means and the second driving control means are constituted as an optional device, and wherein the driving signal is transmitted to the second driving control means using the driving signal transmission means when using the optional device.

12. The image forming apparatus according to claim 1, further comprising medium transport control parameter setting means for setting a medium transport control parameter applied to the second driving control means.

13. The image forming apparatus according to claim 12, wherein the medium transport control parameter setting means sets a transport acceleration correction coefficient of the second transport means with respect to a medium transport acceleration of the first transport means, a value exceeding 0 and less than 1 being set in the transport acceleration correction coefficient.

14. The image forming apparatus according to claim 12, wherein the medium transport control parameter setting means sets a transport start preceding period showing a period in which a medium transport start timing of the second transport means is made to precede a medium transport start timing of the first transport means.

15. The image forming apparatus according to claim 12, wherein the medium transport control parameter setting means sets a correction start transport speed that is a transport speed of the second transport means at which the correction of the medium transport speed of the second transport means is started.

16. The image forming apparatus according to claim 15, wherein the medium transport control parameter setting means sets a value, which is obtained by multiplying a maximum value of the medium transport speed by the first transport means by a coefficient exceeding 0 and less than 1, as the correction start transport speed.

17. The image forming apparatus according to claim 12, wherein the medium transport control parameter setting means sets a value, which is obtained by multiplying a maximum value of the medium transport speed by the first transport means by a coefficient exceeding 0 and less than 1, as a transport speed coefficient.

18. The image forming apparatus according to claim 1, further comprising a reference potential connection wiring line that electrically connects a reference potential of the first driving control means and a reference potential of the second driving control means to each other.

19. An image forming method for forming an image, using imaging forming means, on a medium transported by first transport means for pinching the medium between a first roller and a second roller and driving at least any one of the first roller or the second roller to transport the medium, the image forming method comprising:

a first driving step of driving first driving means including first coupling means coupled to at least any one of the first roller or the second roller and a first driving source coupled to at least any one of the first roller or the second roller via the first coupling means;

a second driving step of assisting in the transport of the medium by the first transport means using second transport means disposed on at least any one of an upstream side or a downstream side of the image forming means in a medium transport direction and of driving second driving means for driving the second transport means; and a driving signal output step of outputting a driving signal applied to the driving control of the first driving means, wherein:

the second driving step controls the driving of the second driving means using the driving signal output in the driving signal output step, the second transport means is provided on the upstream side and the downstream side of the image forming means in the medium transport direction, and a medium fixing plate to which the medium is fixed has a length over the second transport means provided on the upstream side and the downstream side of the image forming means in the medium transport direction.

20. An image forming method for forming an image, using imaging forming means, on a medium transported by first transport means for pinching the medium between a first roller and a second roller and driving at least any one of the first roller or the second roller to transport the medium, the image forming method comprising:

a first driving step of driving first driving means including first coupling means coupled to at least any one of the first roller or the second roller and a first driving source coupled to at least any one of the first roller or the second roller via the first coupling means;

a second driving step of assisting in the transport of the medium by the first transport means using second transport means disposed on at least any one of an upstream side or a downstream side of the image forming means in a medium transport direction and of driving second driving means for driving the second transport means;

a driving signal output step of outputting a driving signal applied to the driving control of the first driving means;

a parallelism detecting step of detecting the parallelism of a second support surface that is a surface of the second transport means which supports the medium, the parallelism detecting step including light beam radiation step of radiating a light beam serving as a reference within a plane parallel to a first support surface of medium supporting means that supports the medium in an image formation region of the image forming means; and a parallelism adjustment step of adjusting the parallelism of the second support surface on the basis of a detection result of the parallelism detecting step, wherein the second driving step controls the driving of the second driving means using the driving signal output in the driving signal output step.

* * * * *